US010830007B2

(12) United States Patent
Belik

(10) Patent No.: US 10,830,007 B2
(45) Date of Patent: Nov. 10, 2020

(54) TUBULAR SUPPORT AND SERVICING SYSTEMS

(71) Applicant: NATIONAL OILWELL VARCO, L.P., Houston, TX (US)

(72) Inventor: Jaroslav Belik, Smithville, TX (US)

(73) Assignee: National Oilwell Varco, L.P., Houston, TX (US)

( * ) Notice: Subject to any disclaimer, the term of this patent is extended or adjusted under 35 U.S.C. 154(b) by 361 days.

(21) Appl. No.: 14/781,959

(22) PCT Filed: Apr. 2, 2014

(86) PCT No.: PCT/US2014/032735

§ 371 (c)(1),
(2) Date: Oct. 2, 2015

(87) PCT Pub. No.: WO2014/165630

PCT Pub. Date: Oct. 9, 2014

(65) Prior Publication Data

US 2016/0047180 A1 Feb. 18, 2016

Related U.S. Application Data

(60) Provisional application No. 61/807,676, filed on Apr. 2, 2013, provisional application No. 61/859,767, filed on Jul. 29, 2013.

(51) Int. Cl.
*E21B 19/06* (2006.01)
*E21B 19/24* (2006.01)
(Continued)

(52) U.S. Cl.
CPC ..... *E21B 19/00* (2013.01); *E21B 17/006* (2013.01); *E21B 17/028* (2013.01); *E21B 19/06* (2013.01); *E21B 19/24* (2013.01); *E21B 47/12* (2013.01)

(58) Field of Classification Search
CPC ..... E21B 19/00; E21B 17/005; E21B 17/028; E21B 19/06; E21B 19/24; E21B 47/12
See application file for complete search history.

(56) References Cited

U.S. PATENT DOCUMENTS 5,479,100 A 12/1995 Fowler et al.
7,096,963 B2 * 8/2006 Moncus ..... B66C 23/208 166/381

(Continued)

OTHER PUBLICATIONS

International Search Report and Written Opinion dated Nov. 7, 2014 for International Application No. PCT/US2014/032735.

(Continued)

*Primary Examiner* — James G Sayre
*Assistant Examiner* — Douglas S Wood
(74) *Attorney, Agent, or Firm* — Conley Rose, P.C.

(57) ABSTRACT

A wellsite system includes a drilling rig, an elevator, and a support system that includes a housing coupled to the drilling rig, a bracket member pivotably coupled to the housing, an actuatable arm coupled to the bracket member and configured to be moveable along an axis of the bracket member, and a servicing system coupled to the actuatable arm, wherein the servicing system is configured to threadlessly engage a tubular. A wellsite servicing system includes a first flange, a second flange configured to engage a flange of a tubular, and a spindle that is pivotable between the first and second flanges such that a central axis of the second flange remains in axial alignment with a central axis of the tubular when the central axis of the tubular is axially misaligned with a central axis of the first flange.

14 Claims, 39 Drawing Sheets

(51) Int. Cl.

| | |
|---|---|
| ***E21B 47/12*** | (2012.01) |
| ***E21B 19/00*** | (2006.01) |
| ***E21B 17/02*** | (2006.01) |
| ***E21B 17/00*** | (2006.01) |

(56) References Cited

U.S. PATENT DOCUMENTS

| | | | | |
|---|---|---|---|---|
| 7,114,235 | B2 * | 10/2006 | Jansch | E21B 19/164 29/464 |
| 7,132,127 | B2 | 11/2006 | Belik | |
| 8,733,213 | B2 * | 5/2014 | Taggart | E21B 19/161 81/57.11 |
| 9,752,398 | B2 * | 9/2017 | Belik | E21B 19/20 |
| 2005/0047884 | A1 | 3/2005 | Belik | |
| 2005/0189118 | A1 | 9/2005 | Moncus | |
| 2010/0102038 | A1 | 4/2010 | Baum | |
| 2010/0230115 | A1 | 9/2010 | Belik | |
| 2014/0110173 | A1 | 4/2014 | Belik | |

OTHER PUBLICATIONS

Extended European Search Report dated Feb. 28, 2017, for patent Application No. 14780145.0.

* cited by examiner

TUBULAR SUPPORT AND SERVICING SYSTEMS

CROSS-REFERENCE TO RELATED APPLICATIONS

This application is a 35 U.S.C. § 371 national stage application of PCT/US2014/032735 filed Apr. 2, 2014 and entitled "Tubular Support and Servicing Systems," which claims the benefit of U.S. Provisional Patent Application Ser. No. 61/807,676, filed on Apr. 2, 2013, entitled "Tubular Coupling Systems and Apparatuses," and U.S. Provisional Patent Application Ser. No. 61/859,767, filed on Jul. 29, 2013, entitled "Movement Compensating Testing Systems and Apparatuses," both of which are incorporated by reference herein in their entireties.

STATEMENT REGARDING FEDERALLY SPONSORED RESEARCH OR DEVELOPMENT

Not applicable.

BACKGROUND

In the oil and gas production industry, during the processes of "tripping" in and out of a wellbore as part of an effort to recover oil and gas, several operations may need to be performed on drill pipe that is either being coupled with or removed from a drill string. For instance, threads that form the housing and pin ends of particular drill pipe tubulars may need to be lubricated prior to being made up or coupled to an adjacent tubular. Also, in the case of wired drill pipe (WDP), testing may be performed on the electromagnetic couplers disposed at each end of the wired drill pipe to increase the reliability of a downhole communications network that is enabled by the functionality provided by the electromagnetic couplers. The performance of these operations may increase the amount of nonproductive time spent during the drilling operation by lengthening the time spent making up or breaking out drill pipe tubulars as they are displaced into or from the wellbore. In some instances, movement by either the WDP itself or the elevator transporting the WDP may result in relative movement between the WDP and the conductivity tester. Such relative movement may jeopardize the coupling between the tester and the WDP necessary to perform a satisfactory test of the conductivity of the WDP.

SUMMARY

For a detailed description of the disclosed embodiments, reference will now be made to the accompanying drawings in which:

In some embodiments, a wellsite system includes a drilling rig, an elevator coupled to the drilling rig, the elevator configured to support a tubular, and a support system disposed on the drilling rig including a housing coupled to the drilling rig, bracket member pivotably coupled to the housing, an actuatable arm coupled to the bracket member and configured to be moveable along an axis of the bracket member, a servicing system coupled to the actuatable arm, wherein the servicing system is configured to threadlessly engage a tubular. The housing may be coupled to the elevator. The servicing system may include at least one of a conductivity tester, a lubricator, and a thread cleaner. The servicing system may include a combination tool configured to test the conductivity of a communicative coupler of a tubular, and lubricate the threads of the tubular. The servicing system may include a combination tool configured to test the conductivity of a communicative coupler of a tubular, clean the threads of the tubular, and lubricate the threads of the tubular. The bracket member may be configured to pivot into alignment with a central axis of the tubular. The actuatable arm may be configured to move the servicing system in a direction coaxial with a central axis of the tubular. The wellsite system may further include a mounting member coupled to the floor of the drilling rig, a base comprising a centralizer configured to couple with the tubular member, and an actuatable arm coupling the mounting member to the base, wherein the actuatable arm is configured to move the base from a retracted position and an extended position, wherein the centralizer contacts the tubular when the base is in the extended position, wherein the base is coupled to the housing of the support system.

In some embodiments, a wellsite servicing system includes a first flange having a central axis, a second flange having a central axis, wherein the second flange is configured to engage a flange of a tubular, and a spindle including a first end and a second end and extending between the first flange and the second, wherein the first end is pivotable at the first flange and the second end is pivotable at the second flange such that the central axis of the second flange remains in axial alignment with a central axis of the tubular when the central axis of the tubular is axially misaligned with the central axis of the first flange. The spindle may include a first ball joint at the first end of the spindle and a second ball joint at the second end of the spindle, and wherein the spindle couples to the first flange at the first ball joint and couples to the second flange at the second ball joint. The servicing system may further include an upper annular cap coupled to an upper end of the spindle and a lower annular cap coupled to a lower end of the spindle, and an upper elastomer disposed between the upper annular cap and the first flange and a lower elastomer disposed between the lower annular cap and the second flange, wherein the elastomers are configured to bias the second flange into axial alignment with the central axis of the tubular. The servicing system may further include a central flange extending radially from the spindle and disposed between the first flange and the second flange, and a plurality of upper springs coupled between the first flange and the central flange and a plurality of lower springs coupled between the central flange and the second flange, wherein the springs are configured to bias the second flange into axial alignment with the central axis of the tubular. The servicing system may further include a communicative coupler coupled to the second flange and configured to engage a communicative coupler of the tubular, wherein the elastomers are configured to provide even circumferential contact between the communicative coupler of the second flange and the communicative coupler of the tubular.

In some embodiments, a conductivity tester for a tubular member includes a locking assembly configured to lock the conductivity tester to a tubular by engaging an inner surface of the tubular, a flange coupled to the locking assembly and configured to engage a flange of the tubular, and a pushing lever coupled to the flange, wherein application of torque to the lever produces an axial force on the flange. The tester may further include a torque limiter coupled between the flange and pushing lever, wherein the torque limiter is configured to prevent the transmission of force between the pushing lever and flange when a predetermined torque threshold is applied to the pushing lever. The tester may further include a spindle extending between the flange and the pushing lever, wherein the torque limiter is threadably coupled to the spindle. The locking assembly may further include an engagement member disposed axially between an upper flange and a lower flange, and a spindle coupled to the lower flange, extending axially through the engagement member and the upper flange, and coupled to a locking lever, wherein the locking lever is configured to produce an axial force on the lower flange when a torque is applied to the locking lever, wherein the lower flange is configured to apply a radial force on the engagement member in response to an axial force applied to the lower flange from the locking lever. The torque limiter may further include an inner mandrel comprising a radially extending aperture, an outer mandrel disposed about the inner mandrel and comprising a plurality of radially extending apertures, a bolt extending into a radial aperture of the outer mandrel and comprising an internal cavity, spring disposed in the cavity of the bolt, and a ball disposed in the cavity of the bolt and in engagement with the spring, wherein the ball is configured to extend partially into the radial aperture of the inner mandrel, wherein torque applied to the outer mandrel is transmitted to the inner mandrel through the ball. The tester may further include a spring disposed in the cavity of the bolt and in engagement with the ball, wherein the spring is configured to provide a force on the ball towards the radial aperture of the inner mandrel, wherein application of a torque to the outer mandrel exceeding a predetermined threshold forces the ball to be displaced from the aperture of the inner mandrel. The tester may further include a locking lever extending into an aperture of the outer mandrel, wherein torque applied to the locking lever is transmitted to the outer mandrel. The flange may include a magnetic coupler configured to engage a magnetic coupler of the tubular.

It is to be understood that both the foregoing general description and the following detailed description are exemplary of the disclosure and are intended to provide an overview or framework for understanding the nature and character of the disclosure as it is claimed. The accompanying drawings are included to provide a further understanding of the disclosure and are incorporated in and constitute a part of this specification. The drawings illustrate various embodiments of the disclosure and together with the description serve to explain the principles and operation of the disclosure.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
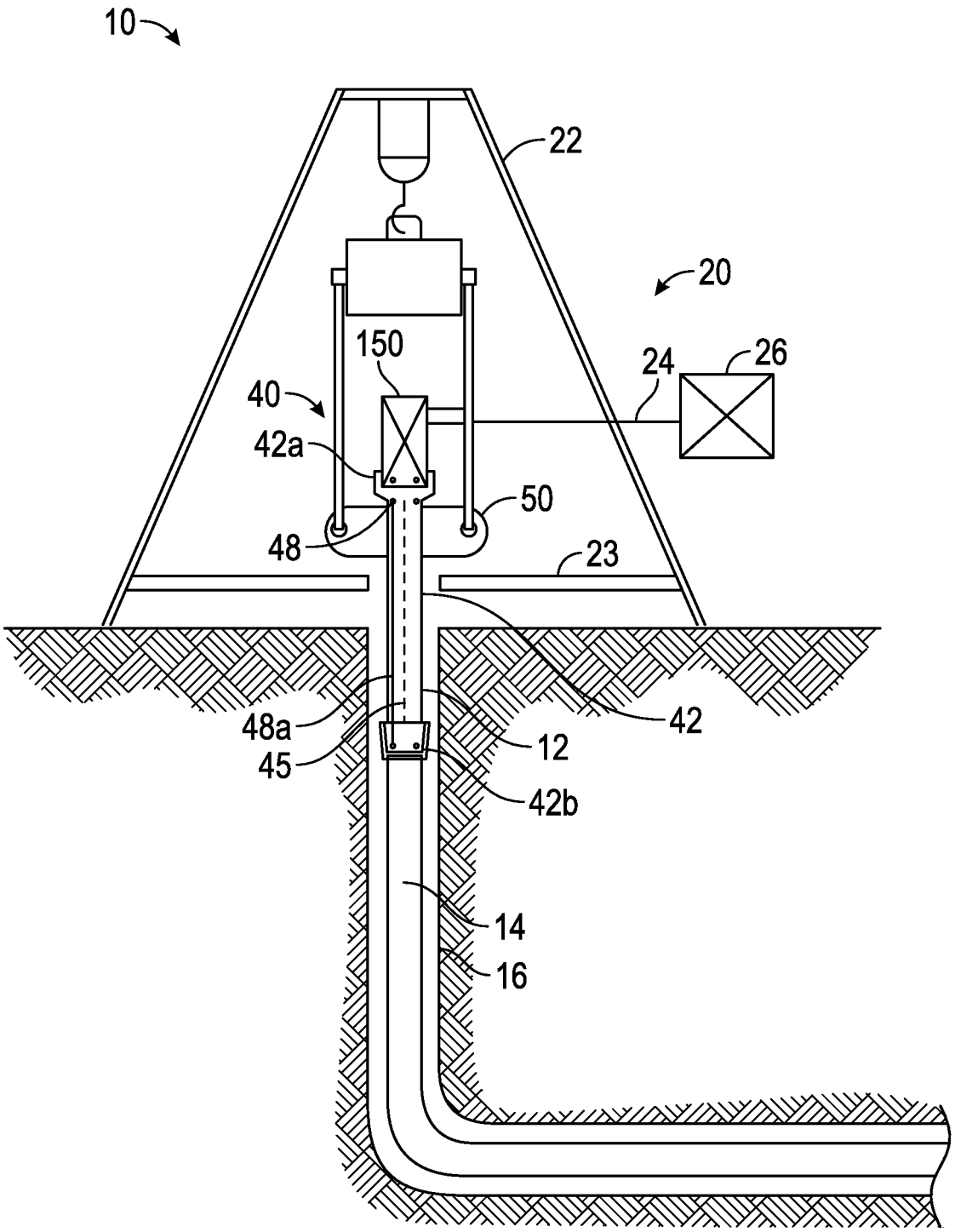
FIG. 1 is a schematic view of a wellsite including a testing system in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The phrase "internal threads" refers to the female threads cut into the end of a length of pipe. The terms "lubricant," "pipe thread dope," "pipe dope," and "thread compound" are interchangeable and describe a material that is capable of sealing and/or lubricating a pipe joint. In addition, reference to the terms "left" and "right" are made for purposes of ease of description. The terms "pipe," "tubular member," "casing" and the like as used herein shall include tubing and other generally cylindrical objects. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Figure 2B:
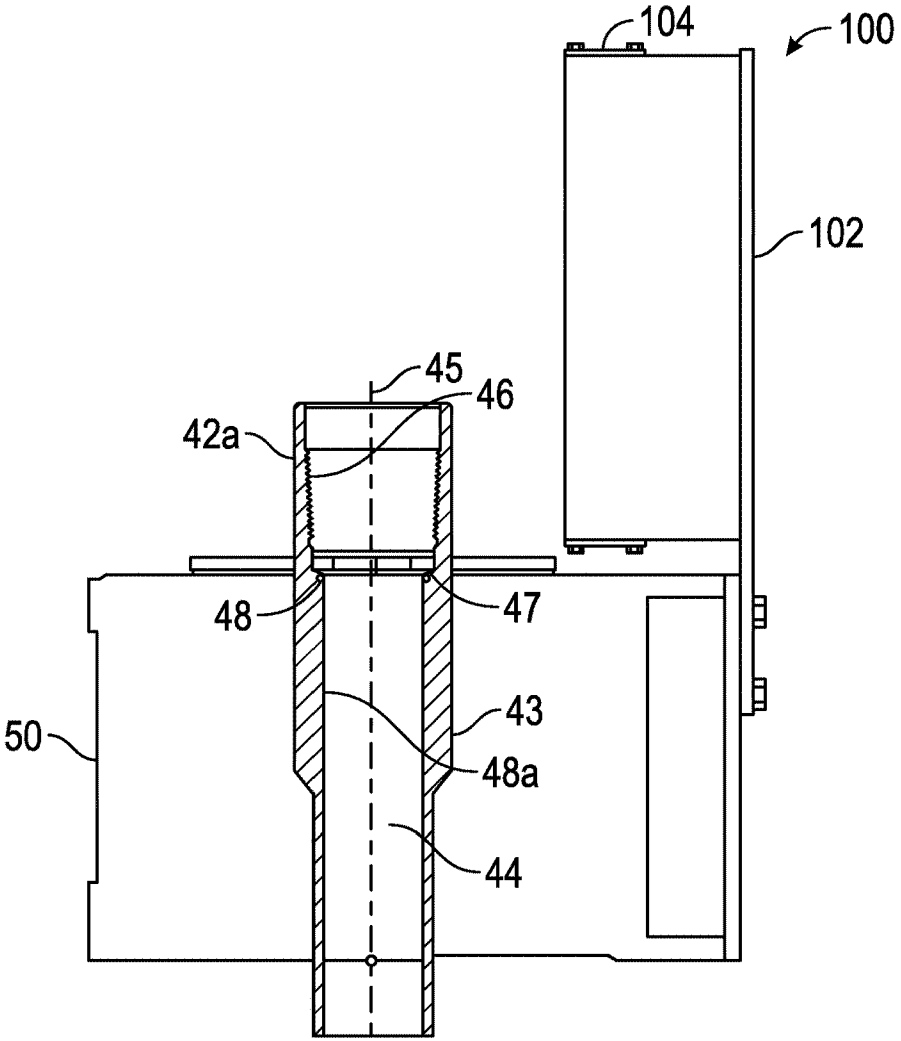
FIG. 2B is a top view of the support system of FIG. 2A in a parked position.
Figure 2A:
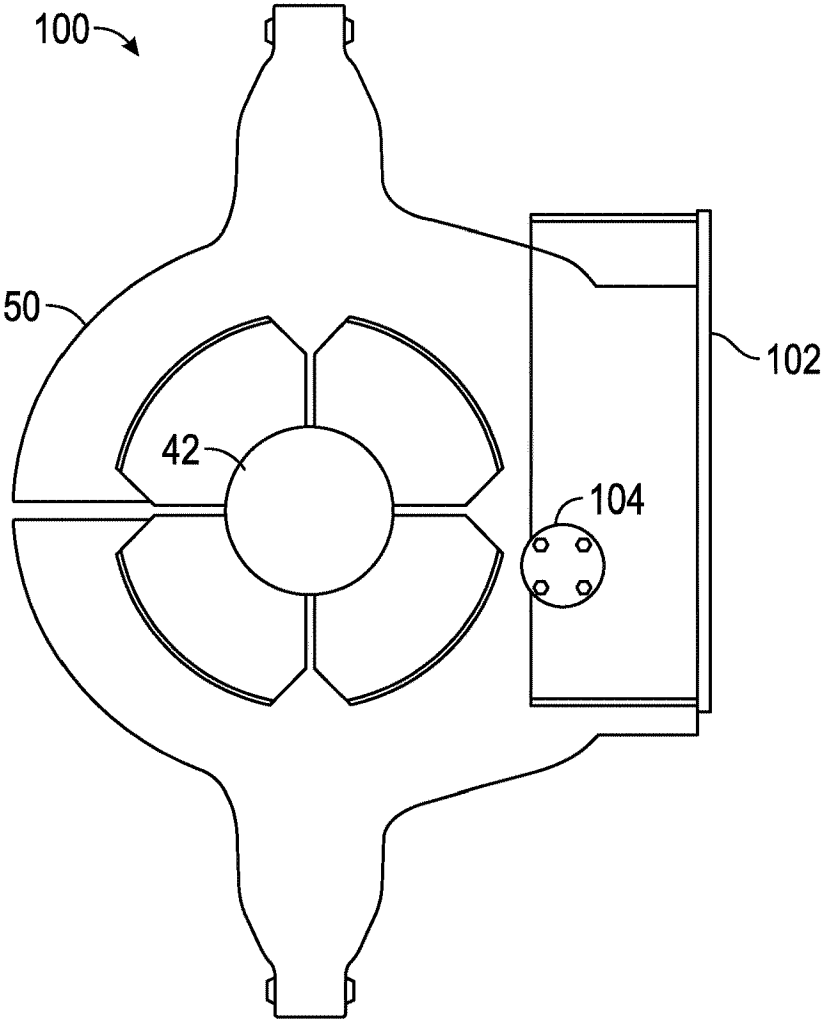
FIG. 2A is a partial sectional view of an embodiment of a system for supporting a coupler in accordance with principles disclosed herein shown in a parked position.

Referring to FIG. 1, an embodiment of a wellsite system 10 is shown. Wellsite 10 includes a downhole system generally including a plurality of tubular or wired drill pipe (WDP) 12 that forms a drill string 14 that extends into the earth to form a wellbore 16. WDP 12 includes an uppermost WDP or tubular 42 having a central or longitudinal axis 45, and a body 43 having a central throughbore 44 (shown in FIG. 2B). The throughbore 44 includes an internally threaded section 46 proximal to an upper box end 42*a* of the tubular 42. Tubular 42 also includes a lower pin end 42*b*. The throughbore 44 also includes an upper facing inner flange 47, proximal to threaded section 46. In this embodiment, flange 47 includes an annular conductor or communicative coupler 48 coupled to a cable 48*a* that extends axially through body 43 of tubular 42 (shown in FIGS. 2A and 2B). Wellsite 10 also includes a surface system 20 that generally comprises a land based derrick or drilling rig 22 having a floor 23, one or more cables 24, a supply system 26, a surface support system 40 and a servicing system 150. Support system 40 generally includes an elevator 50 that supports both the box end 42*a* of the uppermost tubular 42 of string 14 and the servicing system 150. Support system 40 is configured to support and manipulate servicing system 150 while servicing system 150 is configured to interface with tubular 42. For instance, support system 40 is configured to displace servicing system 150 between a parked position and an extended position, where servicing system 150 is shown in the extended position in FIG. 1. In the extended position, servicing system 150 is allowed to engage with tubular 42. In this embodiment, servicing system 150 may comprising one or more of a conductivity tester, a thread cleaner, and a thread lubricator. Also, as shown, supply system 26 is coupled to system 150 via cables 24. Further, cables 24 also couple supply system 26 to support system 40, allowing supply system 26 to provide support system 40 with power and control, whether that power and/or control is pneumatic, hydraulic, electric, etc., in nature.

Elevator 50 of support system 40 is a hinged mechanism that is configured to displace pipe tubulars, including WDP tubular joints (e.g., upper tubular 42), into and out of a wellbore of a well system during the process of tripping in or out of the wellbore. In this embodiment, supply system 26 is configured to interface with servicing system 150 to supply electrical power, pressurized air and fluid, cleaning solution, and lubricant depending upon the needs of the servicing system 150. For instance, embodiments of servicing systems discussed herein include conductivity testers and thread lubricators, as well as other servicing tools and combination tools. While wellsite 10 includes land based derrick 22, it will be appreciated that the wellsite 10 may be land or water based. Also, a portion of the surface system may be offsite or remote from the wellsite 10 and/or in communication with offsite systems. Further, while wellsite 10 includes WDP 12, it will be appreciated that in other embodiments wellsite 10 may incorporate drill pipe that is not wired drill pipe.

Referring to FIGS. 2A-2D, support system 100 generally includes a protective housing 102, a bracket member 104, and an arm 106. In this embodiment, servicing system 150 comprises a tester 160 (see FIG. 2D), and is coupled to support system 100 at arm 108. In this embodiment, tester 160 comprises a first or upper flange 162, a spindle 164, a second or lower flange 166, and a communicative coupler 168 that is coupled to a wire 170. Lower flange 166 is configured to support coupler 168, and upper flange 162 is supported by and coupled with arm 108. Wire 170 extends from coupler 168, through spindle 164 to upper flange 164. Wire 170 ultimately connects with cables 24, allowing communication between coupler 158 and supply system 26. Thus, data provided by coupler 168 may be read or recorded at the supply system 26 on rig 22 of wellsite 10.

In this embodiment, elevator 50 is coupled with and supports housing 102. Uppermost tubular 42 is suspended by the elevator 50. Extending from and coupled to elevator 50 is protective housing 102, which is configured to provide support to the bracket 104, arm 106 and tester 160 via transferring loads applied to housing 102 to the elevator 50. These loads are provided by the weight of bracket 104 and arm 106 as well as other loads. Also, housing 102 is configured to protect servicing system 150 by shielding components of system 150 when in the parked position (shown in FIGS. 2A and 2B). While shown coupled to elevator 50 in FIGS. 2A-2D, protective housing 102 may be positioned adjacent a slip of the well system 10 in other embodiments.

Bracket 104 and arm 106 are coupled to housing 102 and are configured to provide for the displacement of tester 160. Specifically, bracket 104 is hinged to housing 102, allowing for bracket 104 to be rotated about housing 102 between the parked position shown in FIGS. 2A and 2B and an extended position shown in FIGS. 2C and 2D. The parked position allows for the insertion and removal of tubular 42 into elevator 50 while the extended position allows for tester 160 to be extended directly over tubular 42 via arm 106. Once in the extended position, arm 106 and tester 160 may be lowered into an engaged position relative tubular 42 via displacing bracket 104 relative to protective housing 102 and elevator 50. The displacement of bracket 104 may be accomplished using pneumatic, hydraulic, electric or other power and control means. As described above, power (pneumatic, hydraulic, etc.) and electronic control may be provided by cables 24 and supply system 26. In the engaged position, coupler 168 of tester 160 may engage an electromagnetic coupler of tubular 42, allowing for the conduction of electrical signals between supply system 26 connected to tester 160 and tubular 42.

Tester 160 is configured to threadlessly engage tubular 42 via simple physical contact between coupler 168 and a corresponding communicative coupler 48 of wired tubular 42. In this embodiment, tester 160 is a measuring fixture configured to measure wellbore parameters via conducting signals between tubular 42 and other tubulars disposed downhole in wellbore 16. Tester 160 may also test the conductivity of the coupler 48 of tubular 42, as well as the conductivity of the cable 48*a* coupled to coupler 48 and extending between coupler 48 and a corresponding coupler disposed at the opposite end of tubular 42. In this way, the integrity of the electrical circuit formed by the wired drill string 14 may be tested for faults and other issues. Further, because system 150 is mounted to the elevator 50, system 150 may be actuated between the parked position to the extended and engaged positions while the tubular 42 is being displaced into or out of wellbore 16. This allows for the conduction of signals into wellbore 16 as the tubular 42 is being displaced by elevator 50. Thus, it may be possible to minimize the nonproductive time used in making up or breaking out tubulars of drill string 14 by actuating tester 160 while elevator 50 is in the process of displacing tubular 42.

Referring now to FIGS. 3A-3D, another embodiment of a support system 180 for supporting a coupler is shown. In this embodiment, support system 180 generally includes elevator 50, a protective housing or support member 182, an actuator 184, an elongate member 186, bracket 104, arm 106 and tester 160. Support member 182 is coupled to elevator 50 and is configured to provide support to the other components of support system 180. Actuator 184 is coupled between member 186 and support member 182 and is configured to rotate member 186 and may be powered via hydraulic or other means. The power required by actuator 184 may be supplied by supply system 26 via cables 24. Member 186 rotates about a point 186*a* and couples to bracket 104. The rotation of member 186 via actuator 184 moves system 150 between a parked position shown in FIG. 3A and an extended position shown in FIGS. 3B-3D. The member 186 may be positioned in the extended position via a positioning member 188. Once in the extended position, tester 160 may be displaced into an engaged position (shown in FIG. 3D) relative tubular 42 and actuated via passing signals from wire 170 and coupler 168 to tubular 42 as described earlier with reference to system 150. In the engaged position, the lower flange 166 of tester 160 physically engages upper flange 47 of tubular 42, allowing communication between coupler 168 of tester 160 and coupler 48 of tubular 42.

Figure 2D:
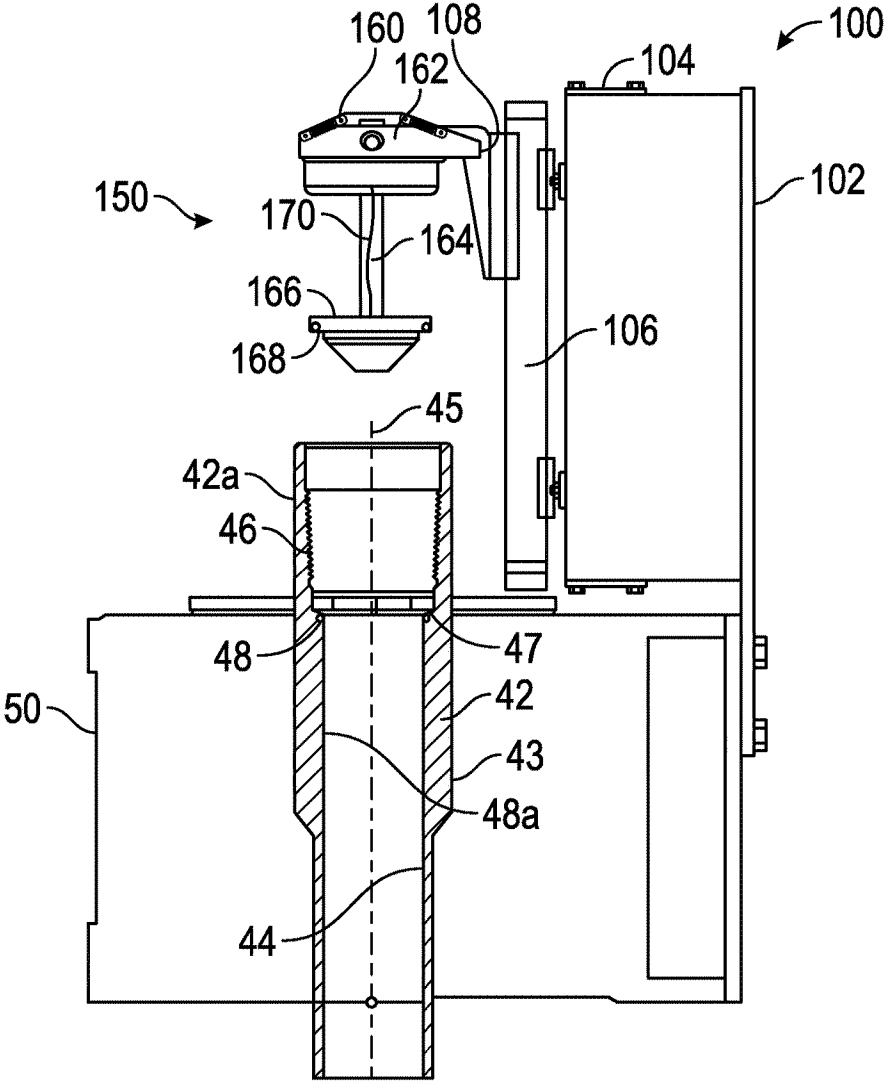
FIG. 2D is a top view of the support system of FIG. 2A in an extended position.
Figure 2C:
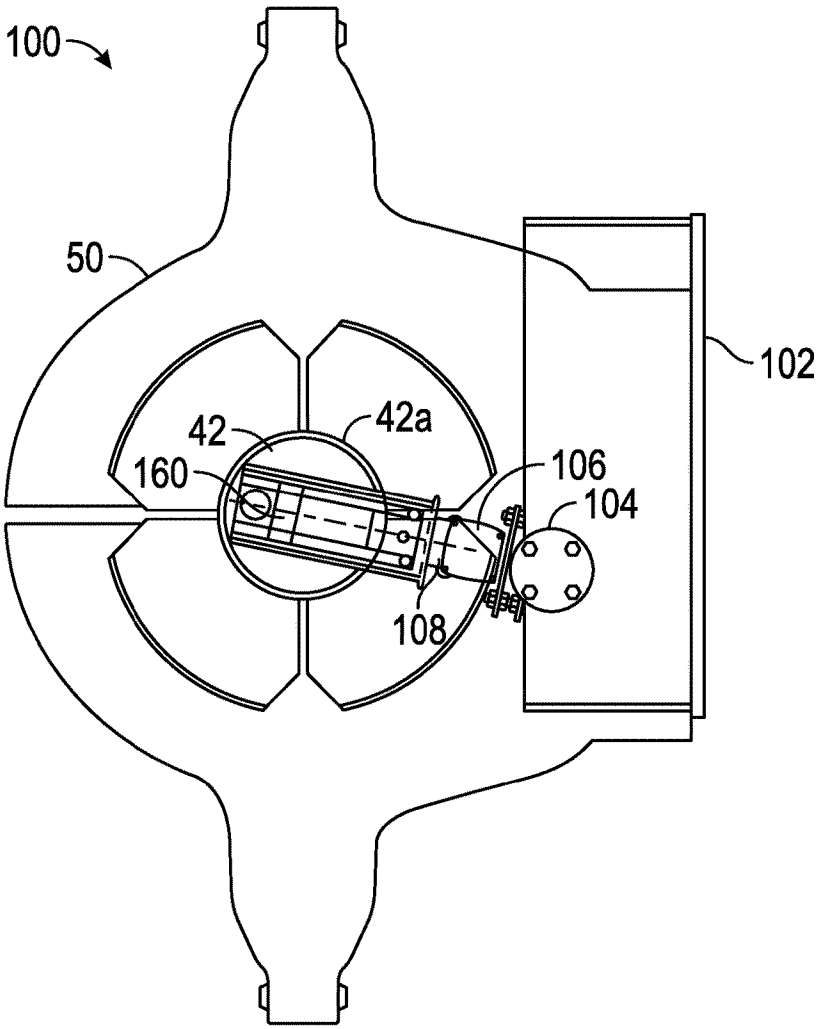
FIG. 2C is a partial sectional view of the support system of FIG. 2A in an extended position.
Figure 3A:
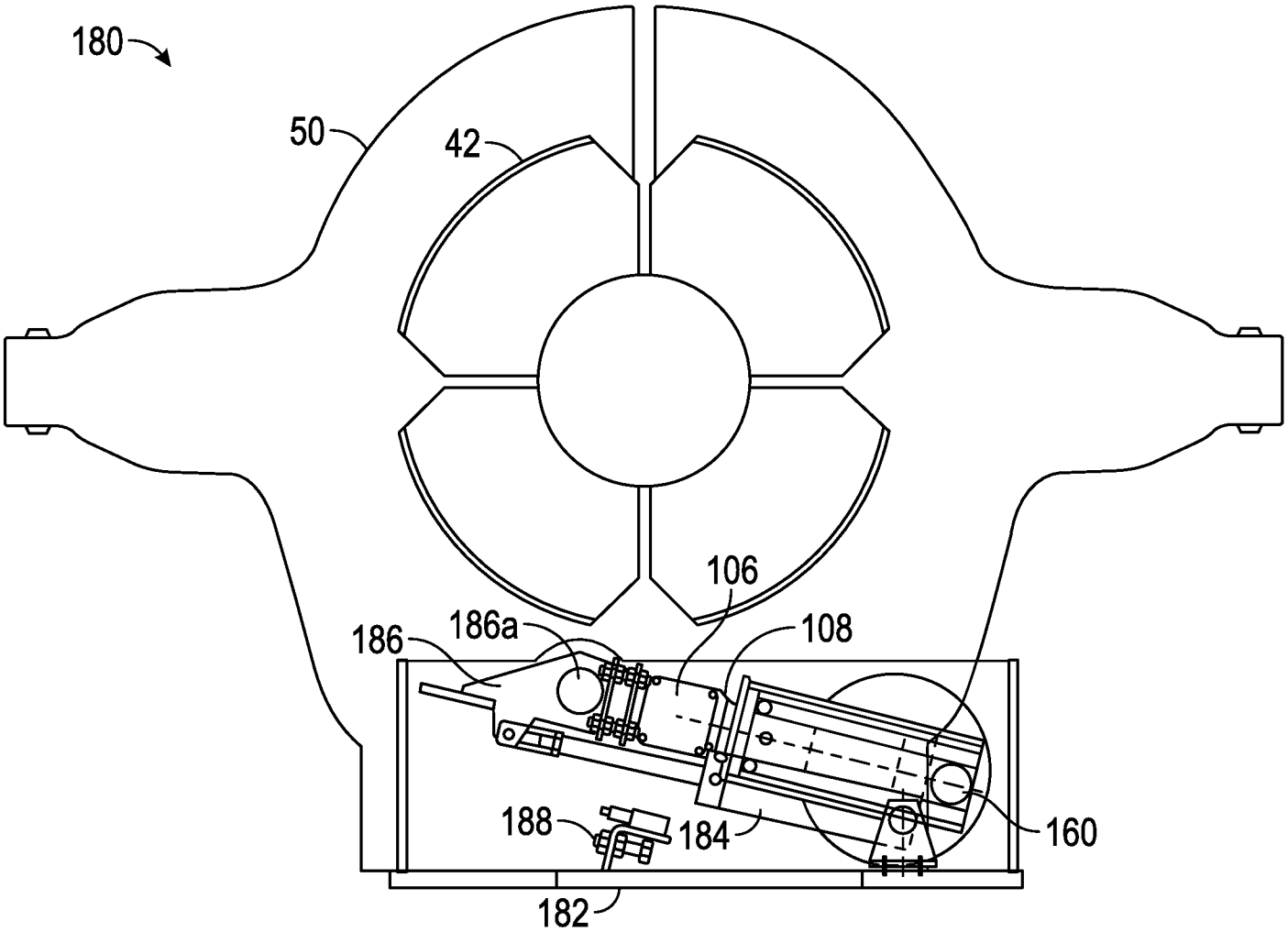
FIG. 3A is a top view of another embodiment of a system for supporting a coupler in accordance with principles disclosed herein shown in a parked position.
Figure 3C:
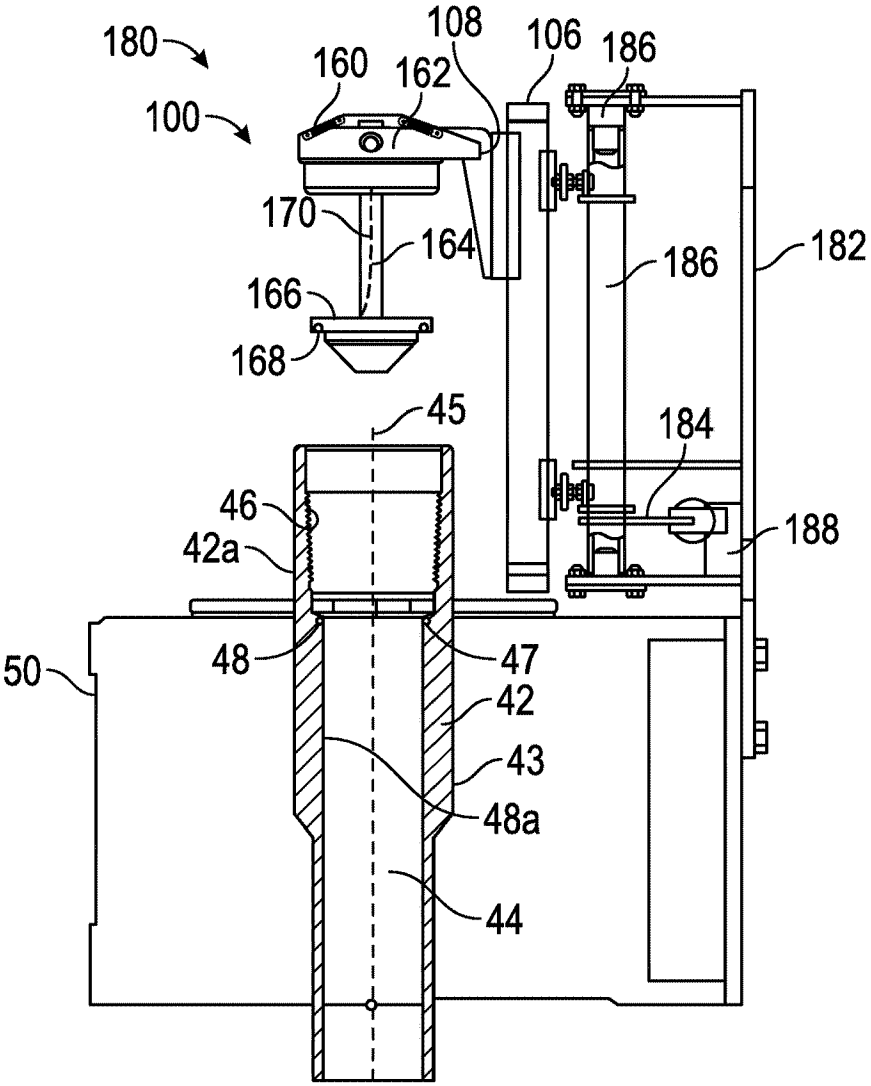
FIG. 3C is a top view of the support system of FIG. 3A in an extended position.
Figure 3B:
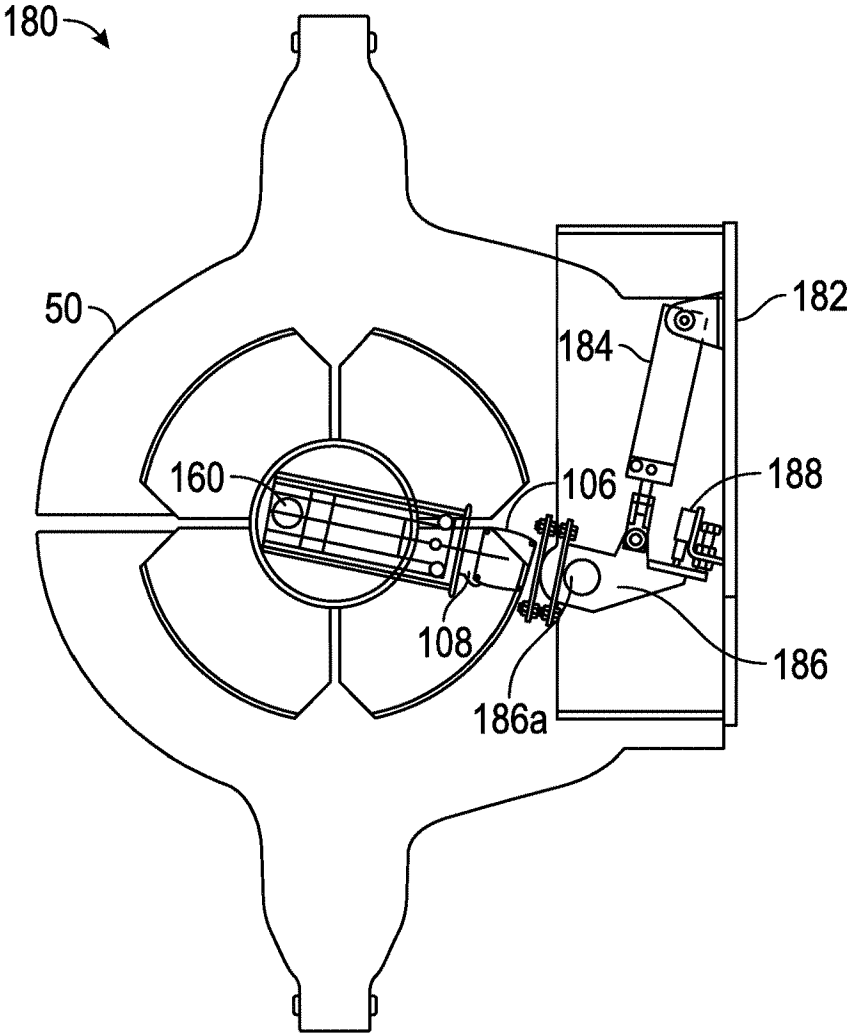
FIG. 3B is a partial sectional view of the support system of FIG. 3A in an extended position.
Figure 3D:
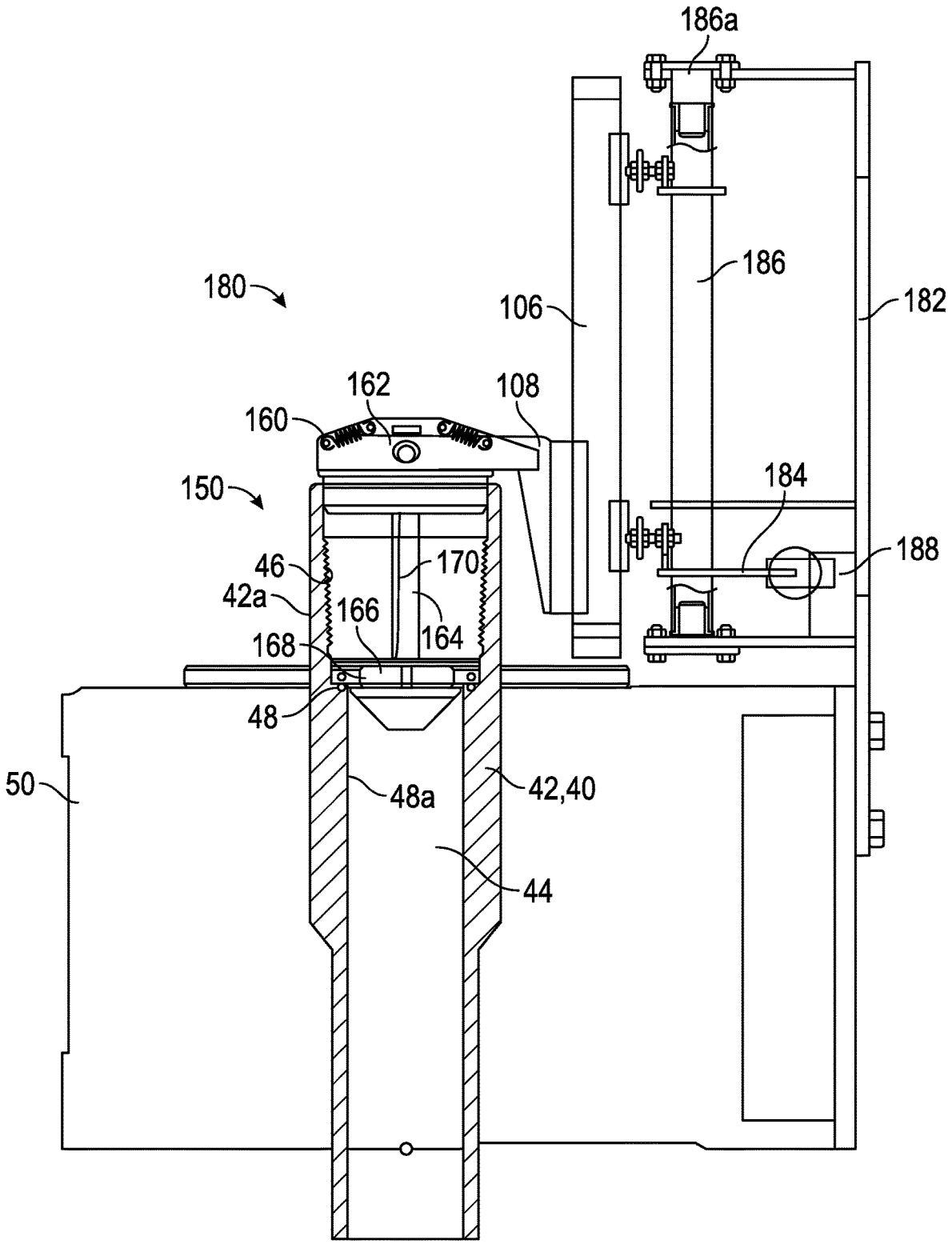
FIG. 3D is a partial sectional view of the support system of FIG. 3A in a coupled position.

In the engaged position, a center axis 165 of tool 160 (shown in FIG. 2D)

Figure 4A:
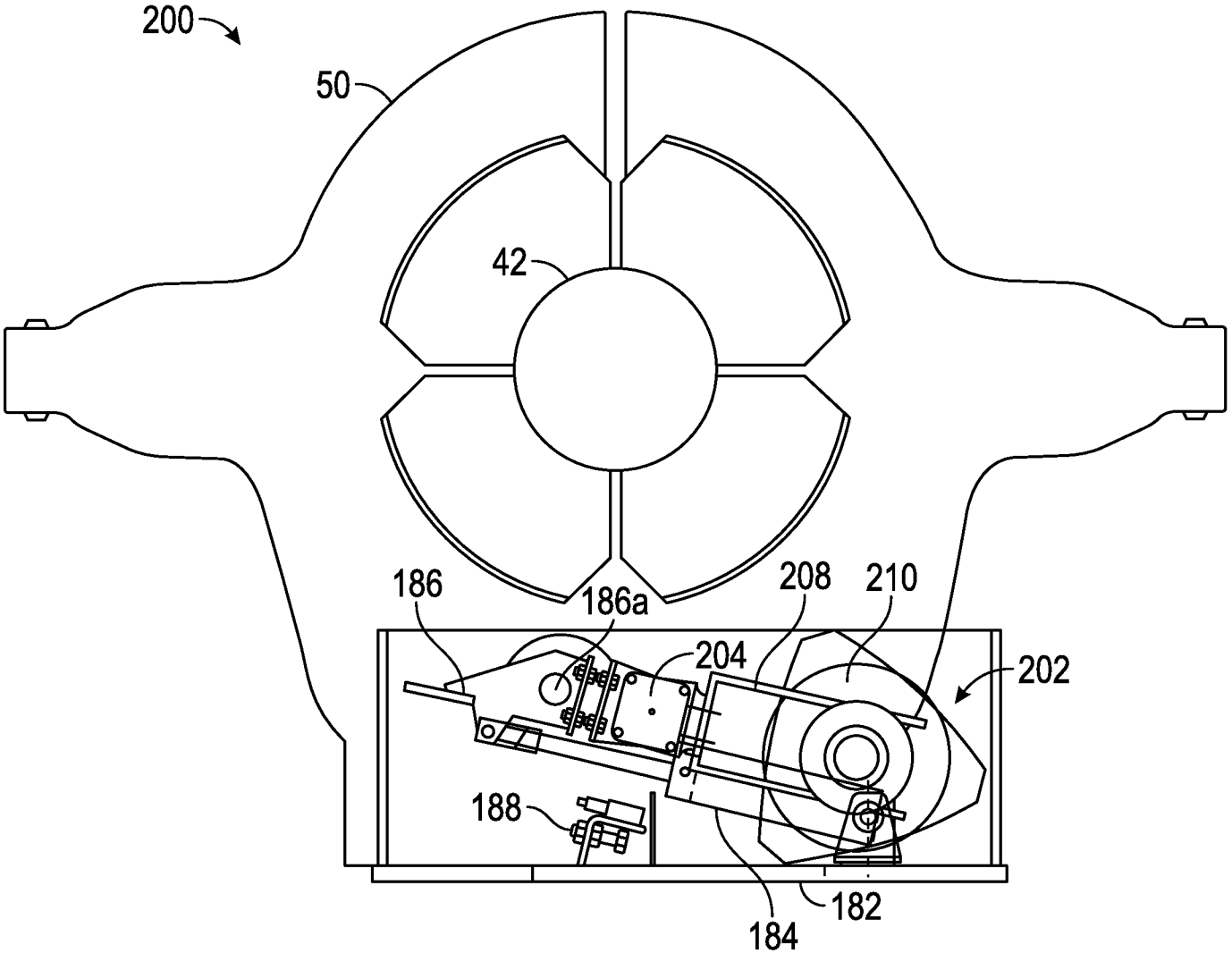
FIG. 4A is a top view of an embodiment of a system for supporting a lubricator in accordance with principles disclosed herein shown in a parked position.
Figure 4B:
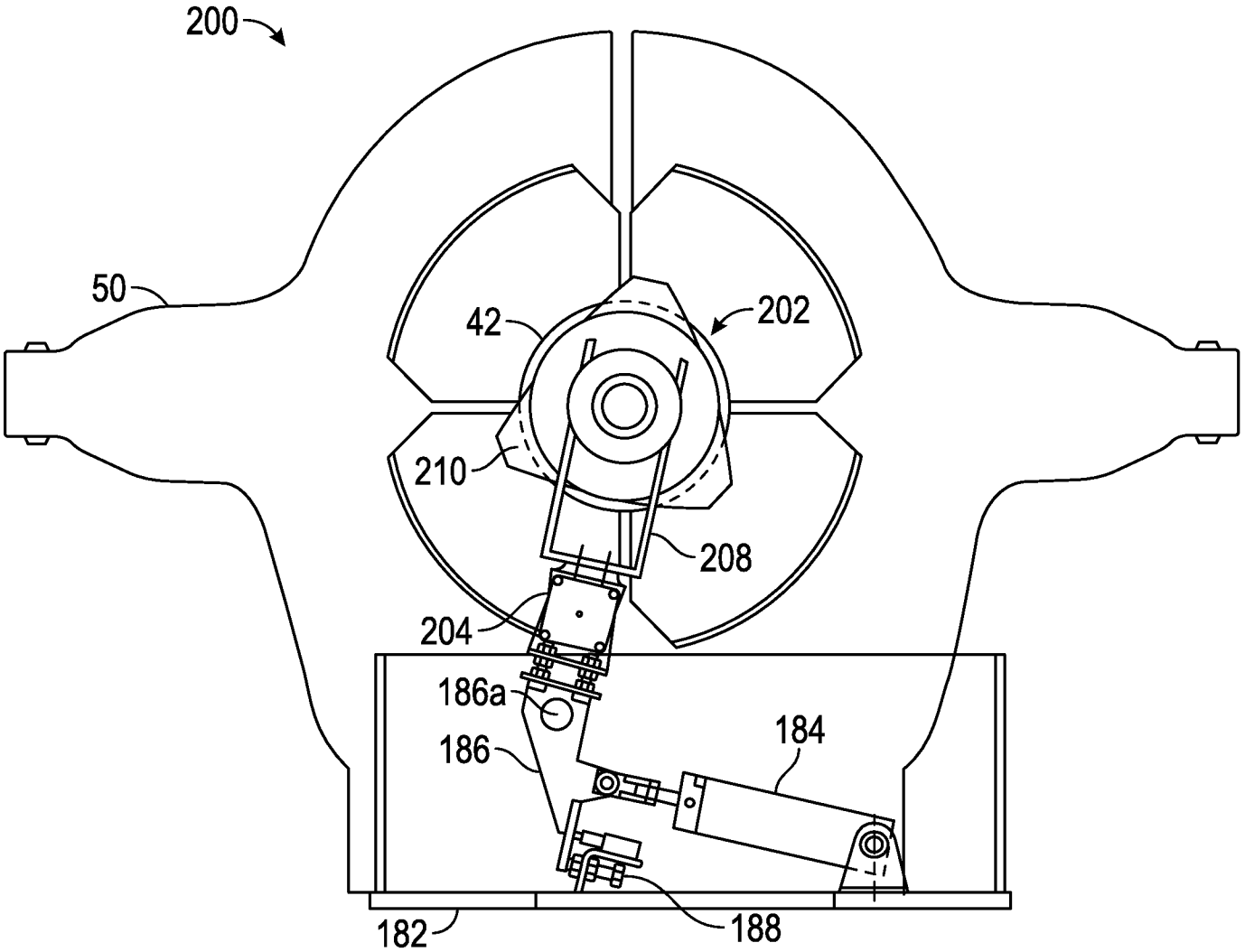
FIG. 4B is a top view of the support system of FIG. 4A in an extended position.
Figure 4C:
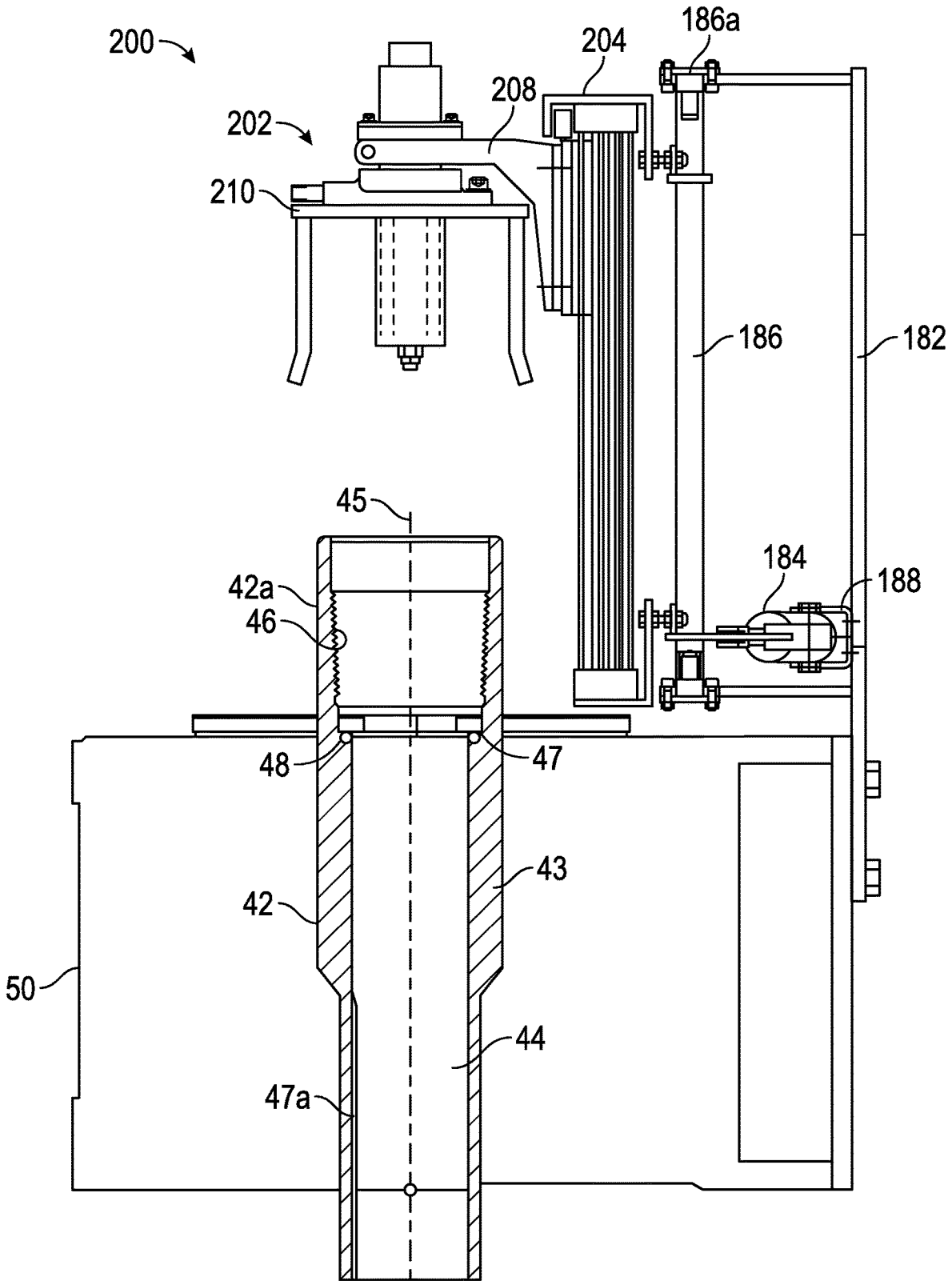
FIG. 4C is a partial sectional view of the support system of FIG. 4A in an extended position.
Figure 4D:
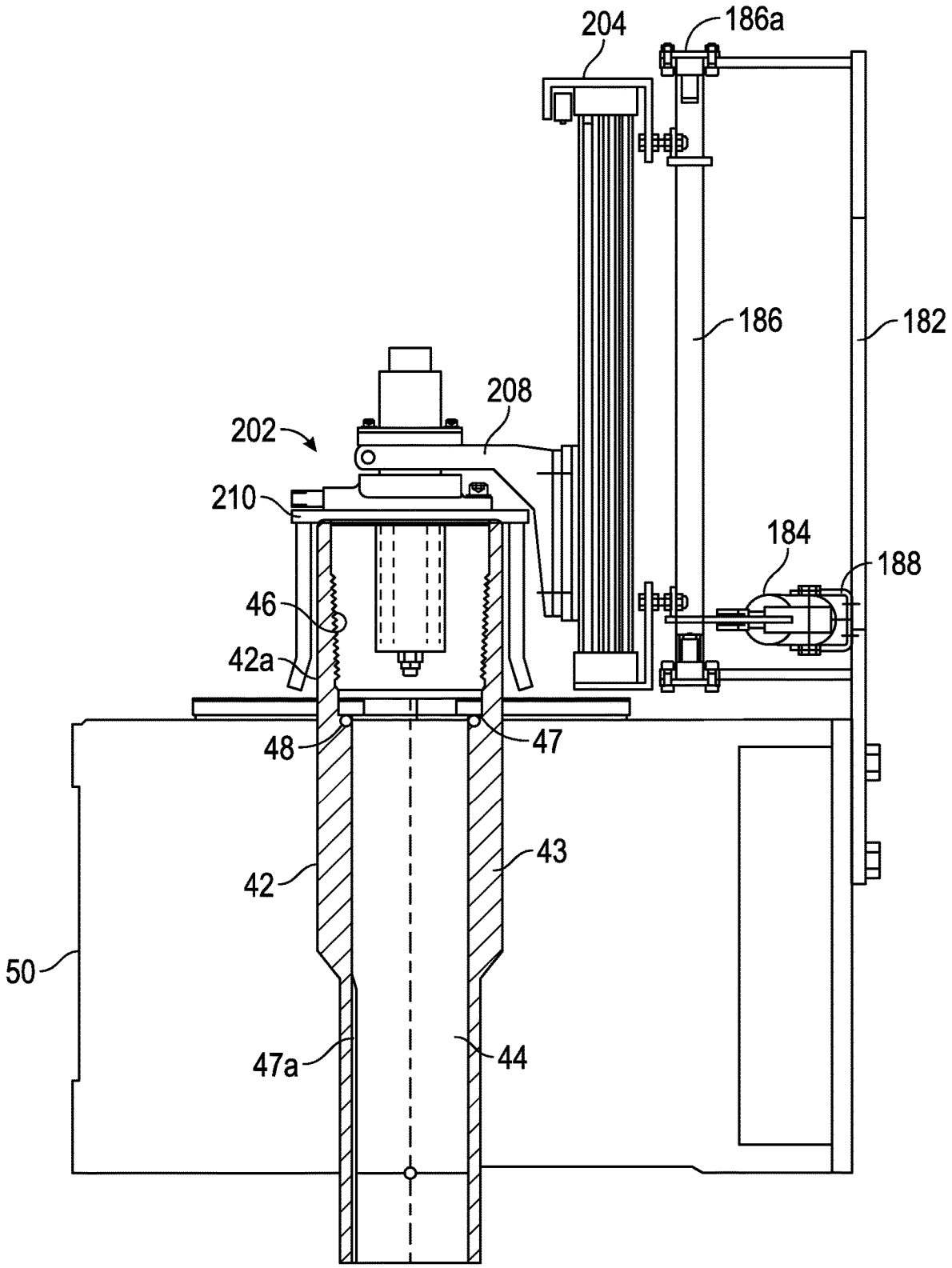
FIG. 4D is a partial sectional view of the support system of FIG. 4A in an engaged position.

Referring now to FIGS. 4A-4D, an embodiment of a support system 200 for supporting a servicing system 202 is shown. Support system 200 includes common features with support system 180, and thus common components are labeled similarly. In this embodiment, system 202 comprising a lubricator 210 and a bracket 204 are coupled to the elevator 50, support member 182, actuator 184 and elongate member 186 via an arm 208 coupled between lubricator 210 and bracket 204. Similar to bracket 104, bracket 204 allows for the vertical displacement of a component (here, lubricator 210) relative to tubular 42, allowing the component to move into an engaged position as shown in FIG. 4B. Also, actuator 184 and elongate member 186 allow for the rotation of lubricator 210 between a parked position (similar to the position shown in FIG. 3A) and an extended position shown in FIGS. 4B4D, allowing for the insertion and removal of tubulars, such as tubular 42, from elevator 50. Threads 46 of tubular 42 may be lubricated via lubricator 210 once support system 200 is disposed in the engaged position as shown in FIG. 4B. Also, by lubricating threads 46 of tubular 42 while displacing tubular 42 using elevator 50, the amount of nonproductive time may be minimized by performing the lubricating operation and displacement of tubular 42 concurrently. Further, in other embodiments many types of lubricators may be used in conjunction with support system 200, including the lubricators disclosed in U.S. Pat. Nos. 7,132,127, 7,963,371 and U.S. Patent Application No. 61/636,096, all of which are incorporated herein by reference in their entirety.

Figure 5:
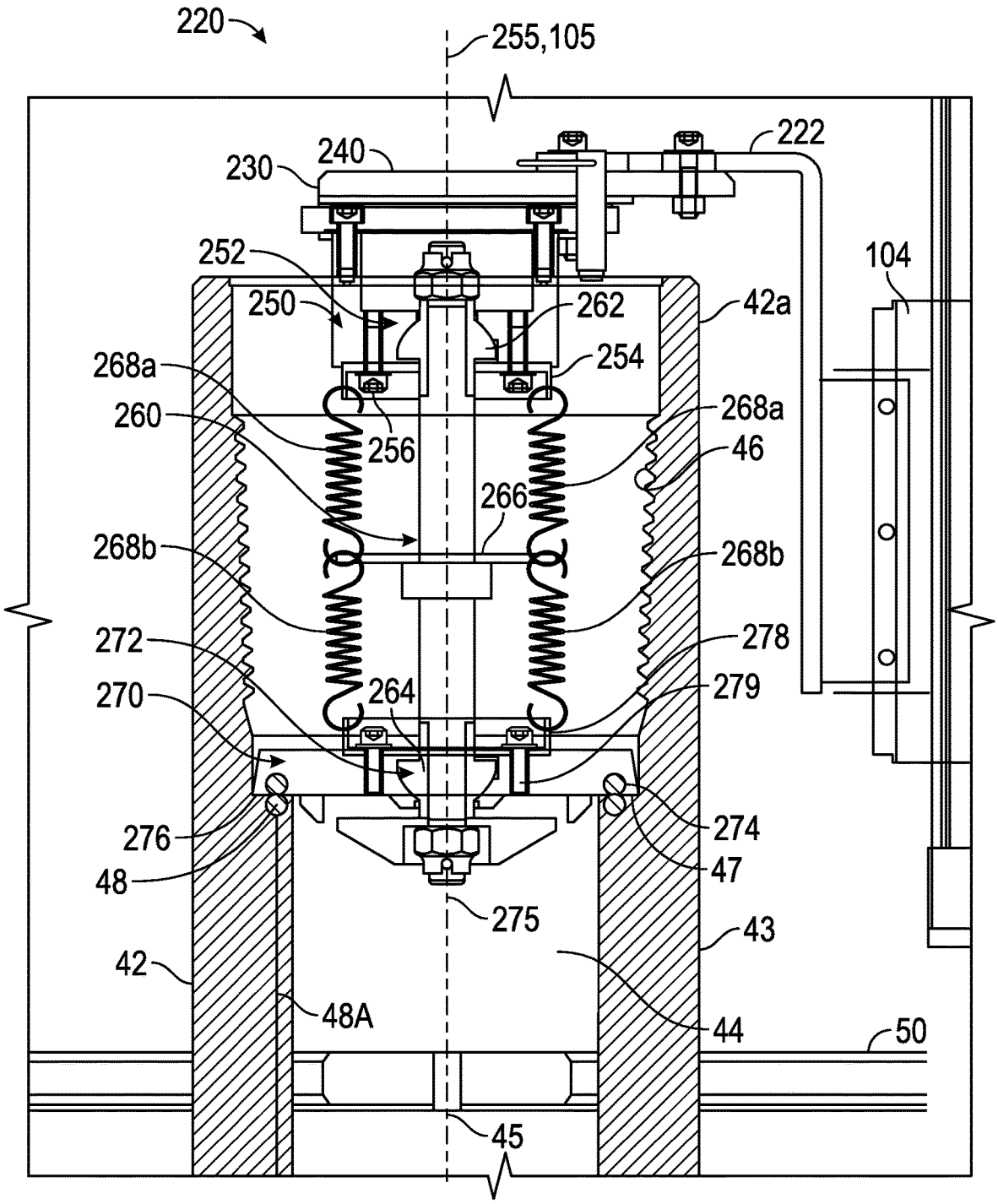
FIGS. 5 and 6 are partial sectional views of an embodiment of a servicing system in accordance with principles disclosed herein.

Referring now to FIG. 5, another embodiment of a servicing system 220 for compensating against relative movement between WDP tubular 42 and a conductivity tester 230 is shown. As tubular 42 is moved by elevator 50 during tripping into or out of wellbore 16, throughbore 44 of tubular 42 may become misaligned with servicing system 220 due to relative movement (e.g., swaying of tubular 42 in elevator 50, etc.) between tubular 42 and the support system described above (i.e., systems 40, 100, 180, and 200). In this embodiment, servicing system 220 is configured to counter the relative movement between the system 220 and the support system such that the system 220 remains stable during operation. In this way, the relative position between the servicing system 220 and the tubular 42 may be stabilized.

In this embodiment, servicing system 220 generally includes a testing apparatus 230 coupled to an arm 222 that is coupled to the bracket 104 of support system 100. While in this embodiment servicing system 220 is shown coupled to support system 100, in other embodiments servicing system 220 may be used with support systems 40, 180, and 200.

Apparatus 230 is configured to threadlessly engage tubular 42 via simple physical contact between apparatus 230 and tubular 42. In this embodiment, apparatus 230 is a testing fixture configured to measure the conductivity of annular coupler 48, cable 48*a* as well as other electrical or magnetic components and/or wellbore parameters via conducting signals between apparatus 230 and other tubulars disposed downhole in wellbore 16. Apparatus 230 generally includes a bracket 240, a first or upper flange 250, a spindle 260 and a second or lower flange 270. The bracket 240 is configured to couple the arm 222 with the upper flange 250, thus allowing the arm 222 and elevator 50 and support system 100 to support the upper flange 250 as well as the rest of the apparatus 230.

In this embodiment, spindle 260 includes a first or upper ball joint 262, a second or lower ball joint 264 and a central flange 266. Upper ball joint 262 is received within receptacle 252 of upper flange 250, which allows upper flange 250 to support the weight of spindle 260 and lower flange 270 while allowing for axial misalignment between the central axis of upper flange 270 and the central axis of spindle 260. Lower flange 270 includes a ball joint receptacle 272 for receiving a lower ball joint 264 of spindle 260, an annular cap 278 and a plurality of orientation pins 279. Similarly, ball joint 264 allows spindle 260 to support the weight of lower flange 270 while allowing for axial misalignment between the central axis of spindle 260 and central axis 275 of lower flange 270. Lower flange 270 includes an annular conductor or coupler 274 configured to transmit electrical signals with coupler 48 when a lower face 276 of lower flange 270 is in physical engagement with inner flange 46 of WDP tubular 42.

Figure 6:
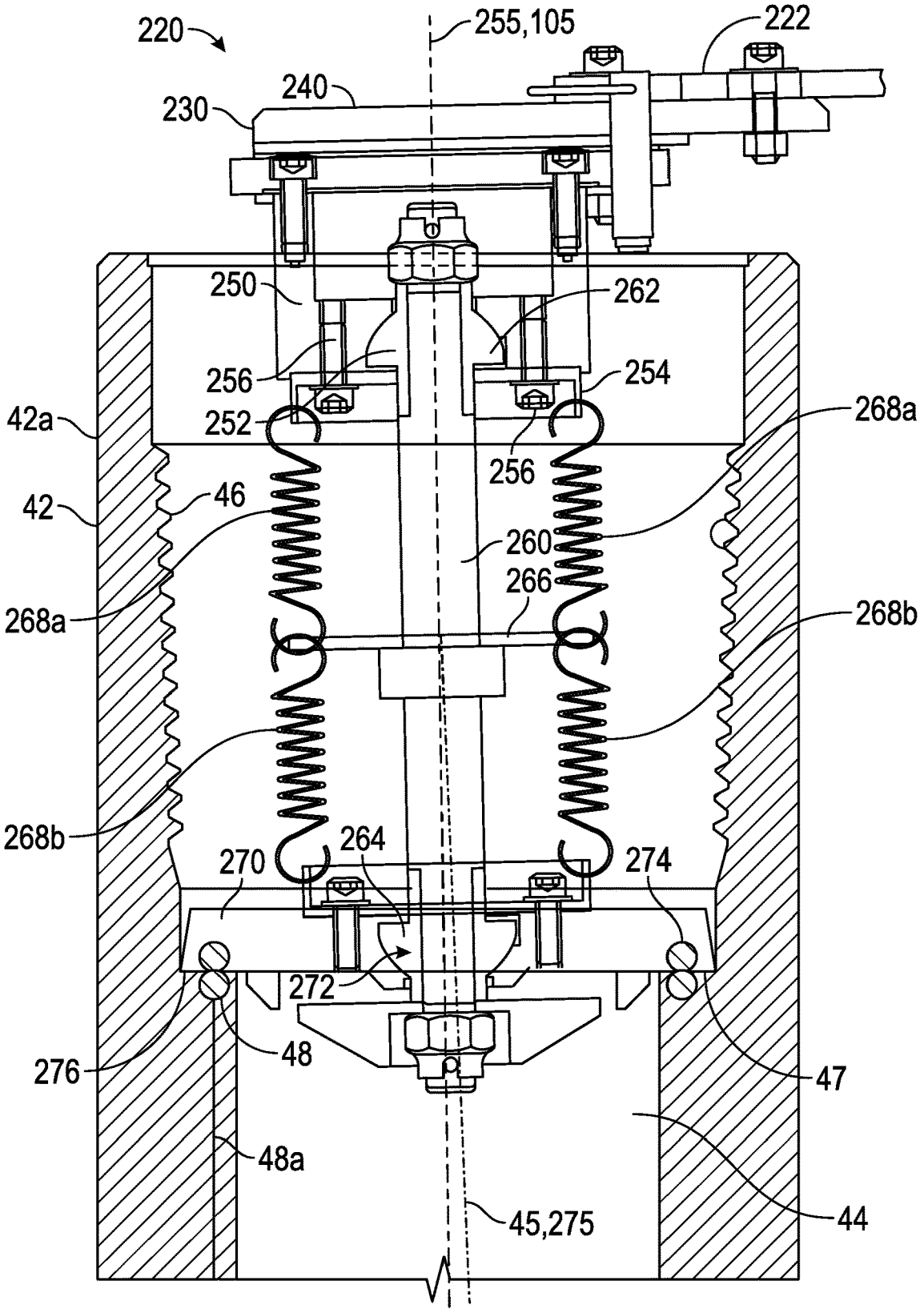

FIG. 5 illustrates WDP tubular 42, support system 100 and apparatus 230 all in axial alignment. However, referring now to FIGS. 5 and 6, the spindle 260 is configured to allow for the axial misalignment of the central axis 255 of the upper flange 255 and a central axis 275 of the lower flange 270. Specifically, upper ball joint 262 is allowed to rotate or pivot relative receptacle 252 of upper flange 250, thus allowing axial misalignment between spindle 260 and upper flange 250. Also, lower ball joint 264 is allowed to rotate or pivot relative receptacle 272 of lower flange 270, allowing axial misalignment between spindle 260 and lower flange 270. As the WDP tubular 42 is displaced by elevator 50 of support system 100, the central axis 45 of tubular 42 may angularly displace relative to, and thus become misaligned with, a central axis 105 of system 100. Such axial misalignment may be produced by jarring motion produced by the elevator 50 or the inertia produced by the weight of the WDP tubular 42. Therefore, in order to allow for proper angular alignment between central axis 275 of lower flange 270 and central axis 45 of tubular 42, spindle 260 is configured to allow for angular misalignment between central axis 275 of lower flange 270 and the central axis 255 of upper flange 250, which is in alignment with central axis 105 of support system 100, as shown in FIG. 6.

If the central axis 45 of tubular 42 enters into misalignment with the central axis of support system 100, the apparatus 230 will allow for even force to be applied circumferentially between the lower flange 270 and the inner flange 46 of tubular 42 in spite of the axial misalignment between tubular 42 and support system 100. Therefore, the ability to provide even circumferential contact between lower flange 270 and inner flange 46, specifically coupler 274 of lower flange 270 and coupler 48 of inner flange 46, may allow for more accurate conductivity testing of coupler 48 and cable 48*a*, as well as associated electrical components or wellbore parameters, in the event of axial misalignment between tubular 42 and support system 100. Further, this alignment feature may prevent the damaging of either the conductivity apparatus 230 or the WDP tubular 42 during conductivity testing.

Apparatus 230 further includes a plurality of first or upper springs 268*a* and lower springs 268*b* configured to urge or bias the central axis 275 of lower flange 270 into alignment with the central axis 255 of upper flange 250. Specifically, upper springs 268*a* are coupled to annular cap 254 that is secured by the plurality of orientation pins 256, which are configured to stabilize upper flange 250. Relative stability of the upper flange 250 may help protect against damaging cable 20 coupled to coupler 274 (not shown in FIG. 5) that passes through spindle 260 and upper flange 250 to couple with device 22. Similarly, second or lower springs 268*b* couple to cap 278, which is secured by orientation pins 279 configured to stabilize lower flange 270. The plurality of upper and lower springs 268 are disposed at different circumferential positions relative to one another. In this arrangement, as the central axis 275 of lower flange 270 becomes misaligned at an angle σ with the central axis 255 of upper flange 250, as shown in FIG. 6, particular circumferentially positioned springs 268 are stretched relative to other circumferentially positioned springs 268, providing a centralizing or biasing force no the lower flange 270 to enter back into alignment with upper flange 250. Specifically, if relative rotation between spindle 260 and upper flange 250 occurs at ball joint 262, then one or more springs 268*a* will be extended as central flange 266 remains in axial alignment with spindle 260. The extended spring(s) 268*a* thus produce a spring force resisting this extension, urging spindle 260 towards axial alignment with upper flange 250. Also, if relative rotation between spindle 260 and lower flange 270 occurs at ball joint 264, then one or more springs 268*b* will be extended as central flange 266 remains in axial alignment with spindle 260. The extended spring(s) 268*b* thus produce a spring force resisting this extension, urging spindle 260 towards axial alignment with lower flange 270. This centralizing force provided by springs 268 may serve to stabilize the alignment of lower flange 270 as force or pressure is applied between apparatus 230 and WDP tubular 42 when lower flange 270 of apparatus 230 is in physical engagement with inner flange 46 of tubular 42.

Figure 7A:
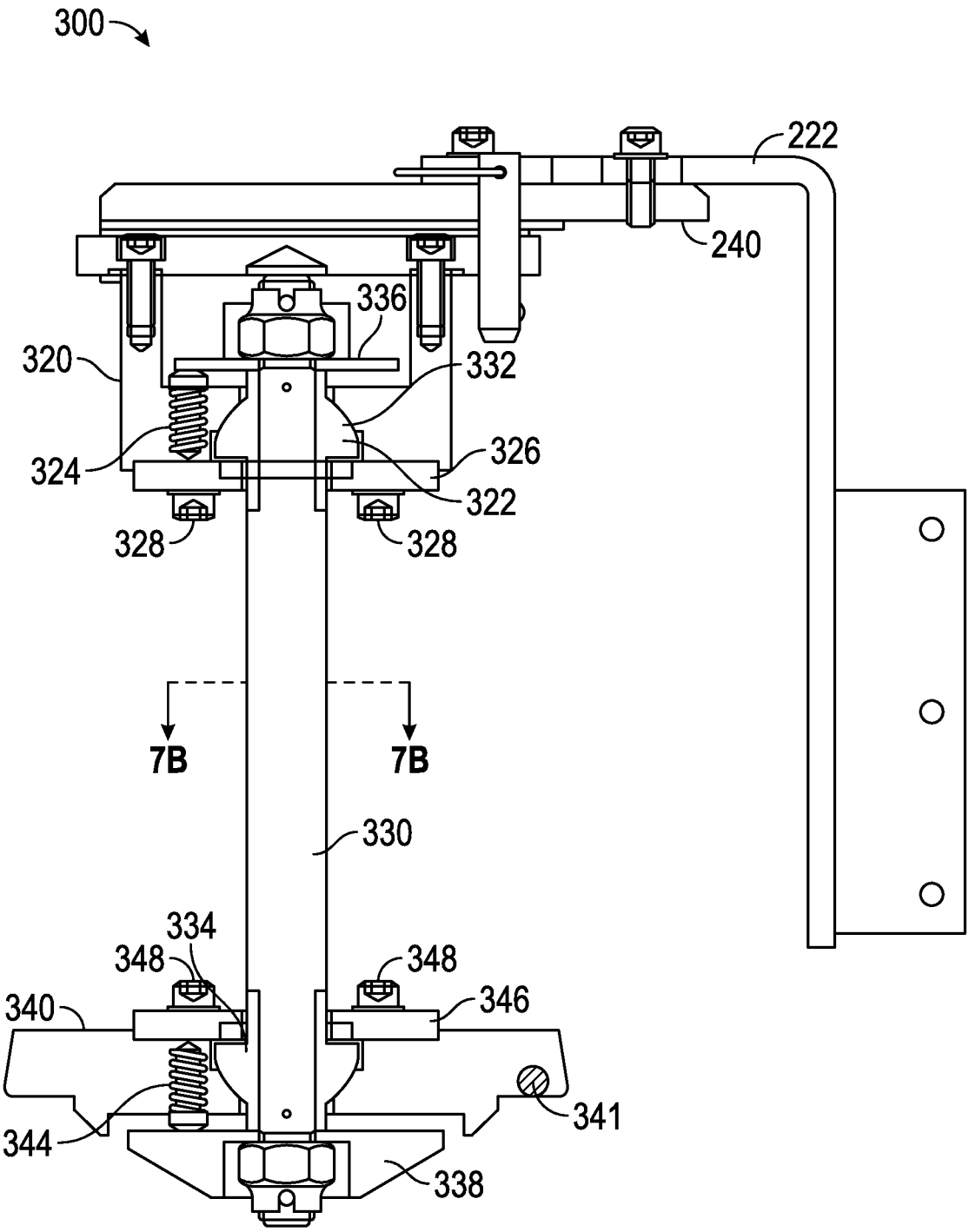
FIG. 7A is a partial sectional view of an embodiment of a testing apparatus in accordance with principles disclosed herein.
Figure 7B:
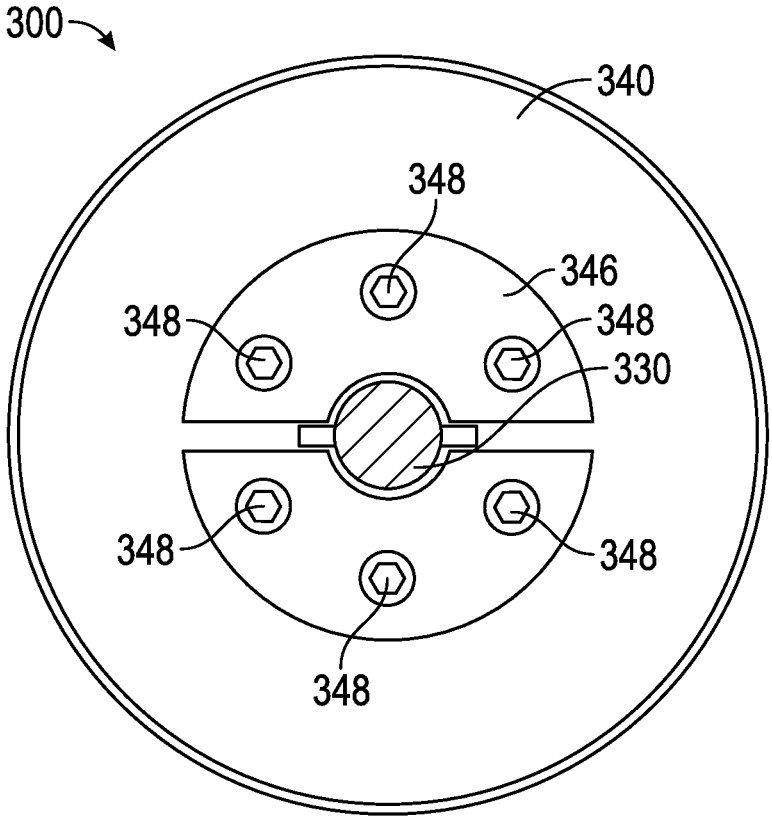
FIG. 7B is a sectional view along line A-A of the embodiment of FIG. 7A.

Referring now to FIGS. 7A and 7B, another embodiment of a testing apparatus 300 is shown. In this embodiment, apparatus 300 generally comprises bracket 240, a first or upper flange 320, a spindle 330 and a lower flange 340. Similar to the embodiments illustrated in FIGS. 5 and 6, apparatus 300 is coupled to a support system (e.g., support system 100) with bracket 240 coupled between upper flange 320 and arm 222. In this embodiment, upper flange 320 includes a ball joint receptacle 322, three circumferentially spaced biasing springs 324 (one shown in FIG. 7A), an annular cap 326 and a plurality of orientation pins 328. Lower flange 340 includes a ball joint receptacle 342 and a plurality of orientation pins 348. While apparatus 300 includes three biasing springs 324, other embodiments may include a greater number of circumferentially spaced biasing springs. Spindle 330 includes a first or upper ball joint 332, a second or lower ball joint 334, a first or upper flange 336 and a second or lower flange 338. Upper and lower ball joints 332 and 334 allow for axial misalignment between the central axis of lower flange 340 and the central axis of upper flange 320 when the tubular (e.g., tubular 42) becomes axially misaligned with its associated support system (e.g., support system 100). Specifically, upper ball joint 332 is allowed to rotate or pivot relative receptacle 322 of upper flange 320, thus allowing axial misalignment between spindle 330 and upper flange 320. Also, lower ball joint 334 is allowed to rotate or pivot relative receptacle 342 of lower flange 340, allowing axial misalignment between spindle 330 and lower flange 340. The axial misalignment between upper flange 320 and lower flange 340 provides for equal circumferential force or pressure applied to an annular conductor or coupler 341 of lower flange 340 when apparatus 300 is in physical engagement with a corresponding tubular.

In this embodiment, upper flange 336 is disposed proximal the upper end of spindle 330 and physically engages biasing spring 324 of upper flange 320. Upper flange 336 of spindle 330 and biasing spring 324 are configured to provide a stabilizing or axially aligning force between spindle 330 and upper flange 320. Thus, as with springs 338*a* of apparatus 230, when spindle 330 rotates relative to upper flange 336 at the ball joint 332 and the central axis of spindle 330 becomes axially misaligned with the central axis of upper flange 320, spring 324 urges or biases the central axis of spindle 330 to return to axial alignment with upper flange 320. Similarly, lower flange 340 also includes a biasing spring 344, which physically engages lower flange 338 of spindle 330. Lower flange 344 also includes an annular cap 346 and a plurality of orientation pins 348. In this arrangement, spring 344, cap 346 and pins 348 stabilize lower flange 340 and urge or biases the spindle into axial alignment with lower flange 340.

Figure 8A:
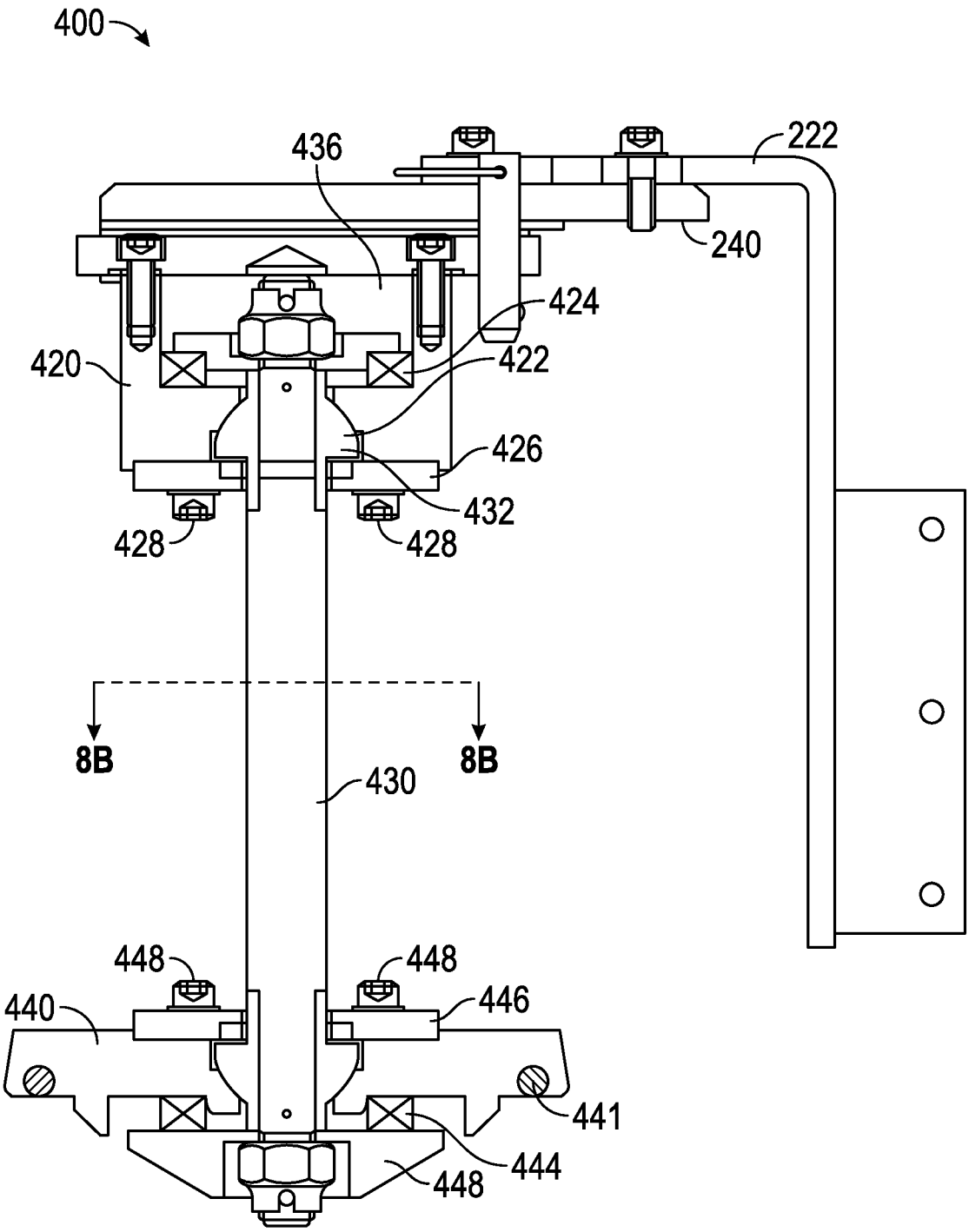
FIG. 8A is a partial sectional view of another embodiment of a testing apparatus in accordance with principles disclosed herein.
Figure 8B:
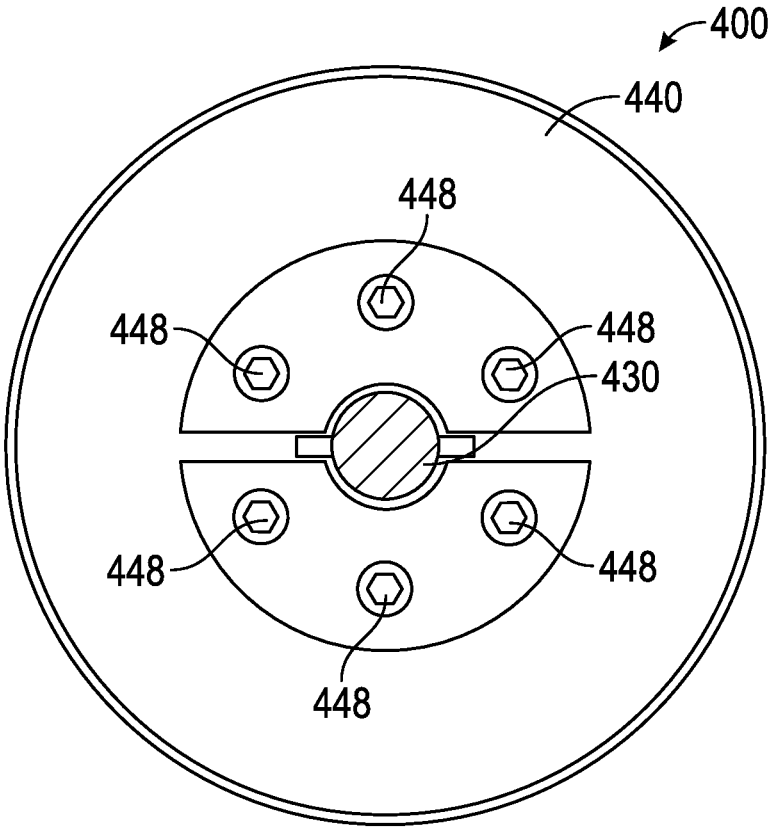
FIG. 8B is a sectional view along line B-B of the embodiment of FIG. 8A.

Referring now to FIGS. 8A and 8B, another embodiment of a testing apparatus 400 is shown. In this embodiment, apparatus 400 generally comprises bracket 240, a first or upper flange 420, a spindle 430 and a lower flange 440. As with apparatus 200, apparatus 400 is coupled to a support system (e.g., support system 100) with bracket 240 coupled between upper flange 420 and arm 222. In this embodiment, upper flange 420 includes a ball joint receptacle 422, an annular elastomer 424, an annular cap 426 and a plurality of orientation pins 428. Spindle 430 includes a first or upper ball joint 432, a second or lower ball joint 434, a first or upper flange 436 and a second or lower flange 438. Upper and lower ball joints 432 and 434 allow for axial misalignment between the central axis of lower flange 440 and the central axis of upper flange 420. The axial misalignment between upper flange 420 and lower flange 440 provides for equal circumferential force or pressure applied to an annular conductor or coupler 441.

In this embodiment, upper flange 436 is disposed proximal the first or upper end 430*a* of spindle 430 and physically engages biasing spring 424 of upper flange 420. Upper flange 436 of spindle 430 and elastomer 424 are configured to provide a stabilizing or axially aligning force between spindle 430 and upper flange 420. Therefore, when spindle 430 rotates relative to upper flange 432 and the central axis of spindle 430 becomes axially misaligned with the central axis of upper flange 420, elastomer 424 urges or biases the central axis of spindle 430 to return to axial alignment with upper flange 420 via physical engagement between elastomer 424 and upper flange 432 of spindle 430 and upper flange 420, respectively. Similarly, lower flange 440 also includes an annular elastomer 444, which physically engages lower flange 438 of spindle 430. Lower flange 440 also includes an annular cap 446 and a plurality of orientation pins 448. In this arrangement, elastomer 444, cap 446 and pins 448 stabilize lower flange 440 and urge or biases the spindle into axial alignment with lower flange 440.

Referring now to FIGS. 9A-9G, a system 520 for supporting a lubricator and coupler apparatus is shown. In contrast to the embodiments shown in FIGS. 2A-4D, in this embodiment support system 520 is disposed proximal rig floor 23 of rig 22, and thus is not coupled or disposed on elevator 50. Also, in this embodiment floor 23 of rig 22 includes slips 28 configured to support suspended tubular 42. System 520 generally includes a base 522 having a centralizer 522*a*, a support member 524, an actuator 526, a sliding bracket 528 and a servicing system 600. Member 524 is coupled to the rig 52 near the rig floor 23 via base 522 and adjacent to centralizer 522*a* for centralizing tubular 42 as it is being displaced into or out of slips 28 of the rig 22. Member 524 provides load bearing support for system 520 via coupling with the drilling rig 22. Also, member 524 allows for the vertical displacement of servicing system 600 relative to the rig 22 and centralizer 522*a* via actuator 526.

System 520 further includes a mounting member 534, a support bracket 536, an actuator 538 and a pair of arms 540. In this embodiment, mounting member 534 is directly coupled to rig floor 23 and is positioned proximal slips 28 of rig 22. Bracket 536 is coupled to member 534 and may be disposed at different vertical positions of member 534 depending on the needs of the application. Arms 540 are coupled to bracket 536 and may be rotated about mounting member 534 via actuation of the actuator 538, which may be powered using pneumatic, hydraulic or other power sources. The power required by actuator 538 may be supplied by supply system 26 via cables coupling actuator 538 and system 26. Base 522 and system 600 may be positioned directly over slips 28 via rotating arms 540 relative to member 534. Rotation of arms 540 via displacement of actuator 538 provides for the displacement of base 522 and system 600 between a parked position (shown in FIG. 9A) and an extended position (shown in FIGS. 9B-9D).

Actuator 526 is coupled to support member 524 and sliding bracket 528 and is configured to vertically displace system 600 using powered actuation, such as using pneumatic, hydraulic, electrical or other power sources. Similar to actuator 538, the power required by actuator 526 may be supplied by supply system 26 via cables coupling actuator 538 and system 26. In this way, system 600 may be positioned over a box end of a tubular (e.g., box end 42*a* of tubular 42) and displaced vertically in unison with the tubular as it enters into or out of the wellbore. System 600 may be engaged with the tubular by disposing system 600 over the box end of the tubular. A limit switch 542 (shown in FIGS. 9F and 9G) and a force adjustment mechanism 544 may be used to limit the travel of sliding bracket 528 as it moves towards centralizer 522*a*. Thus, operations may be performed on the tubular, such as lubricating threads of the tubular or testing the conductors and communicative couplers of WDP tubulars, as the tubular is being displaced relative to the rig 22 and wellbore 16, which may reduce the amount of nonproductive time used in the process of installing or uninstalling tubulars from the drill string of the well system.

Figure 9A:
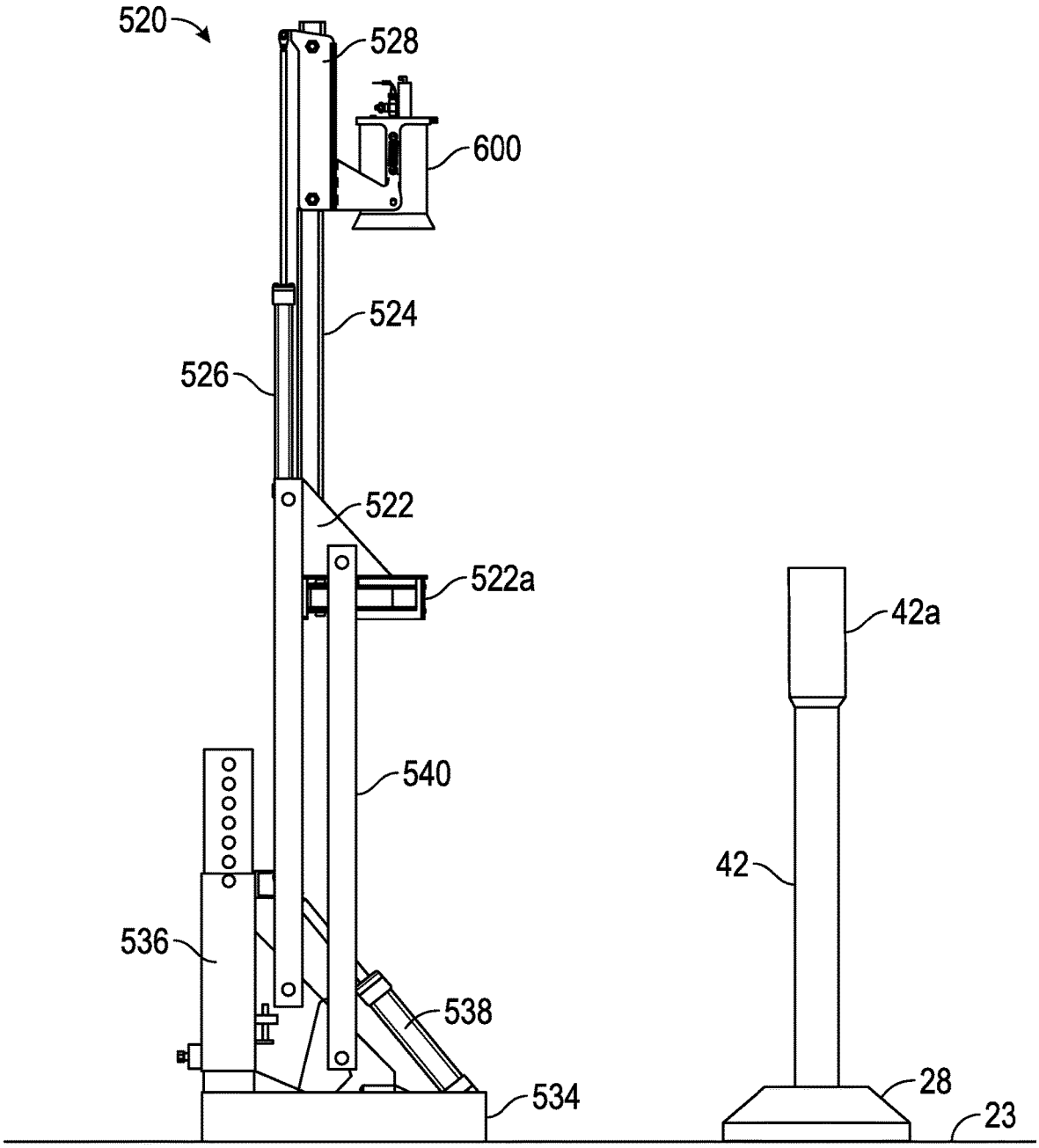
FIGS. 9A-9G are side views of another embodiment of a system for supporting a coupler and lubricating apparatus in accordance with principles disclosed herein.
Figure 9B:
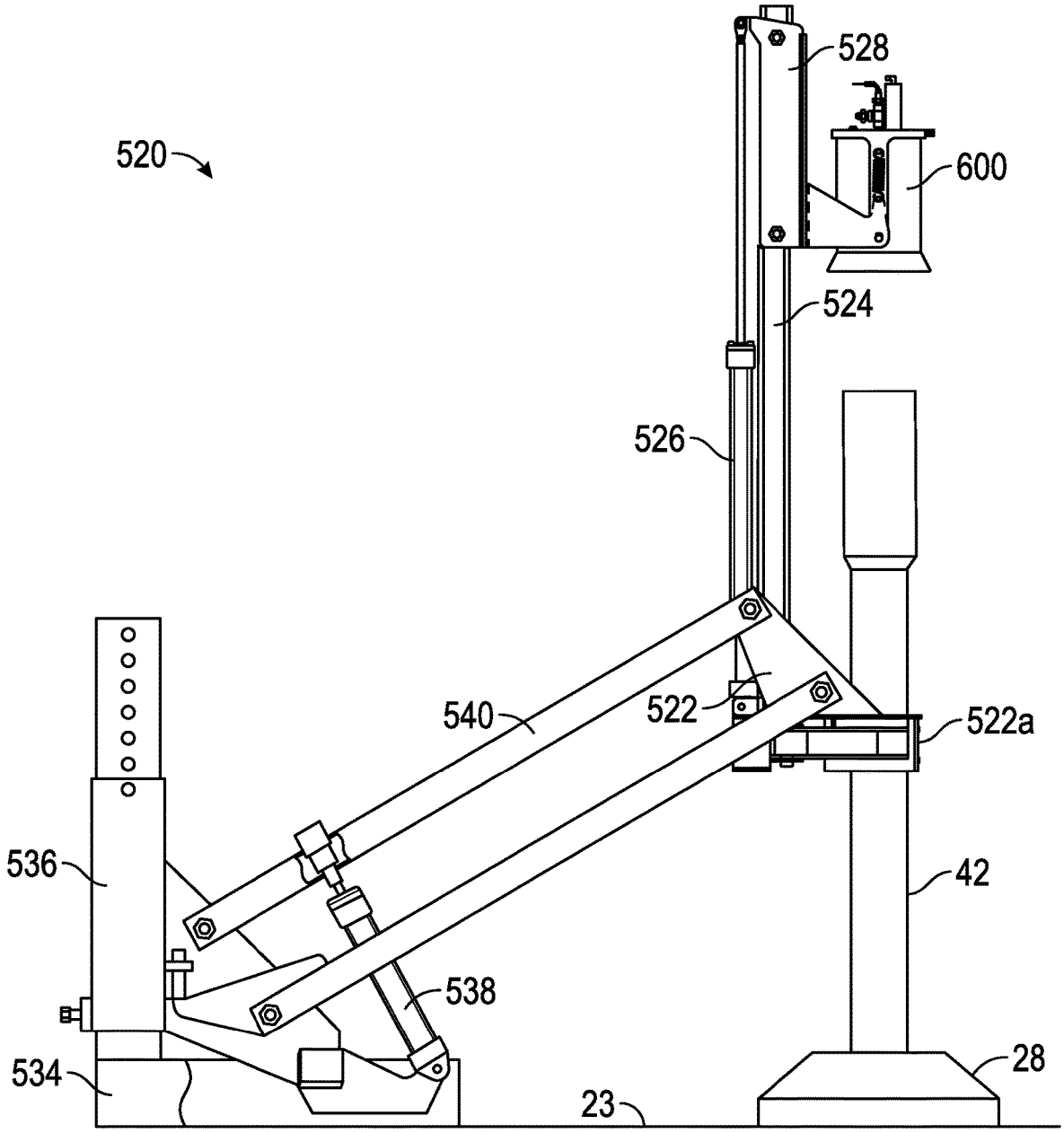
Figure 9C:
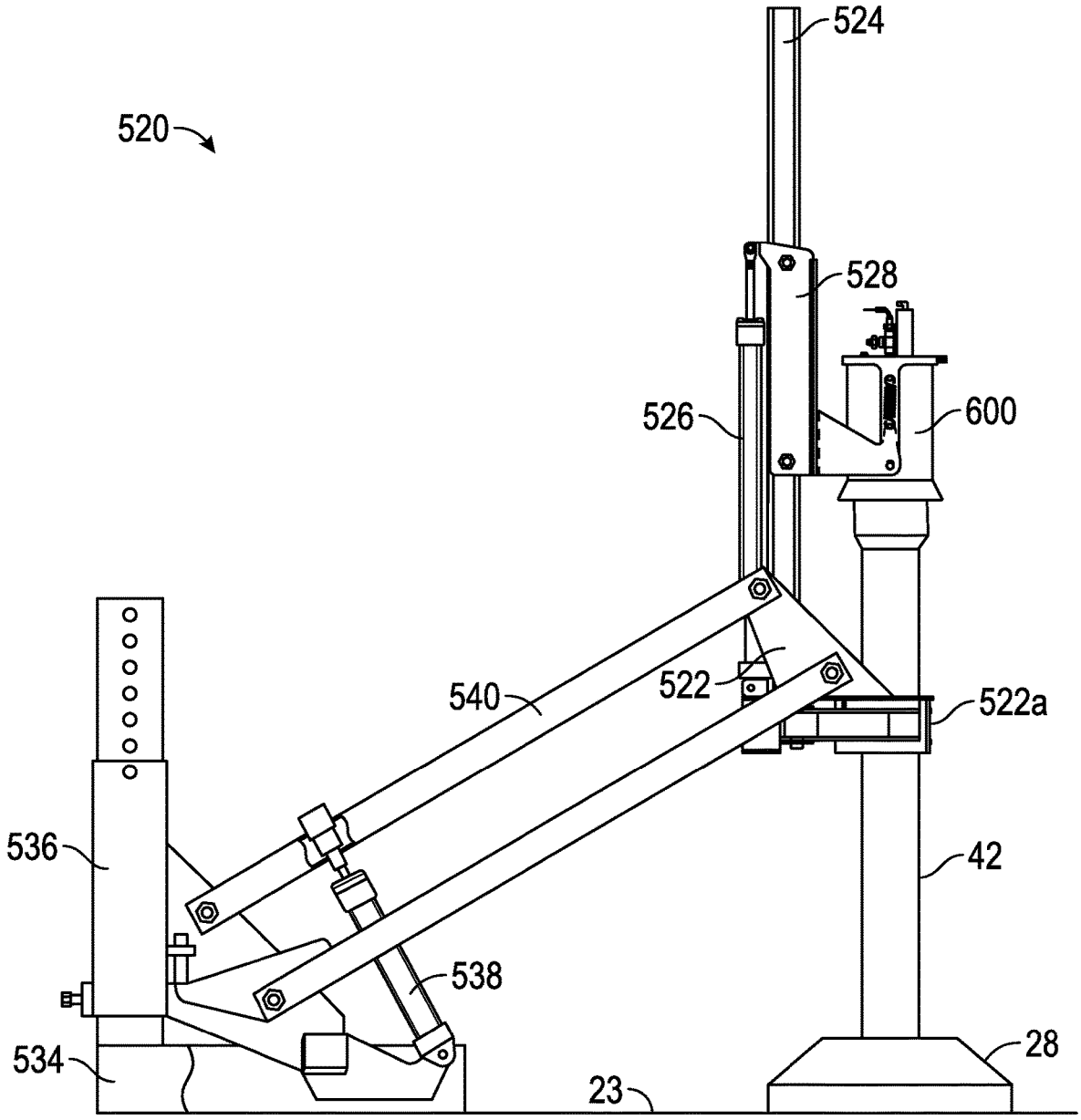
Figure 9D:
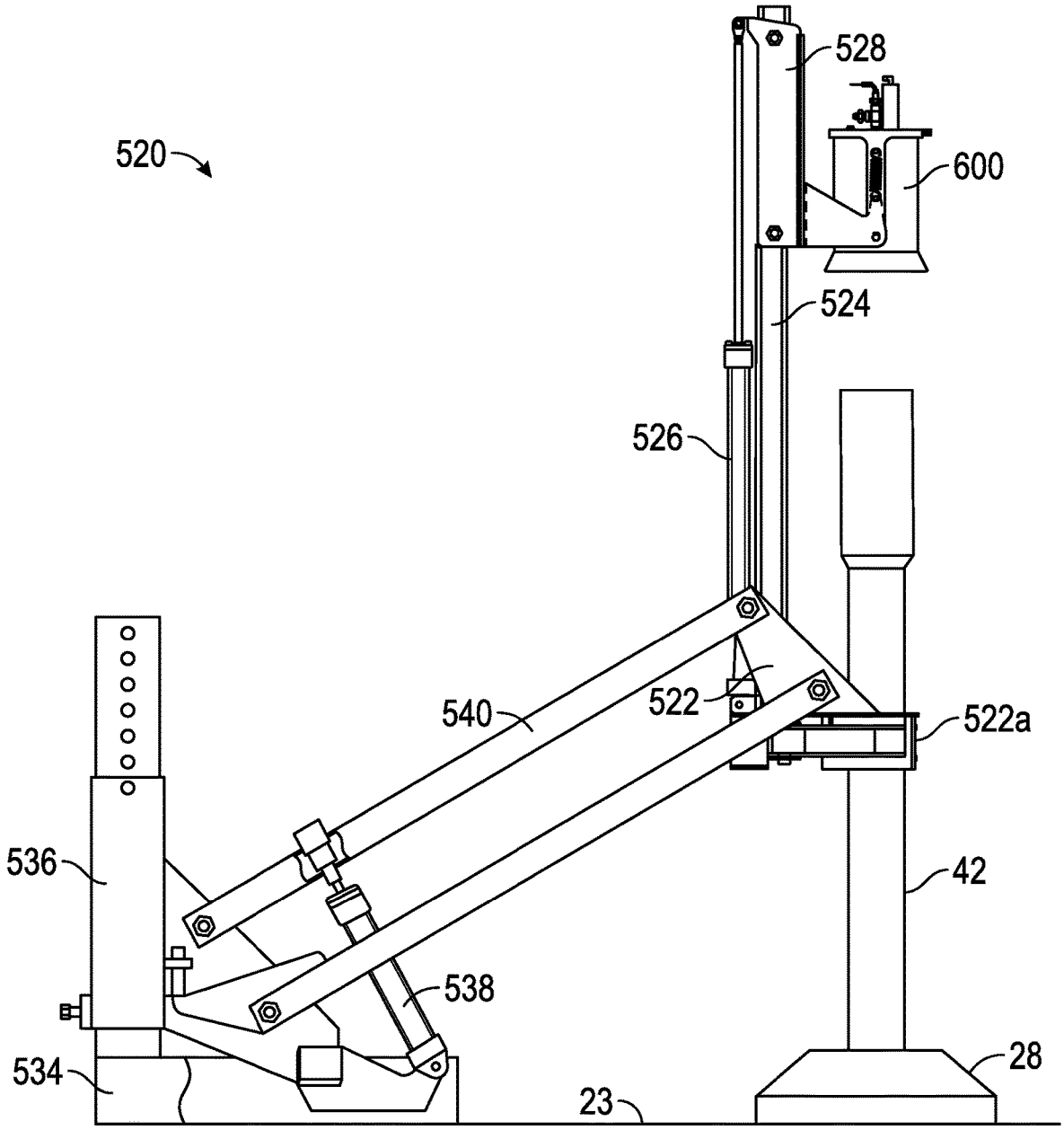
Figure 9E:
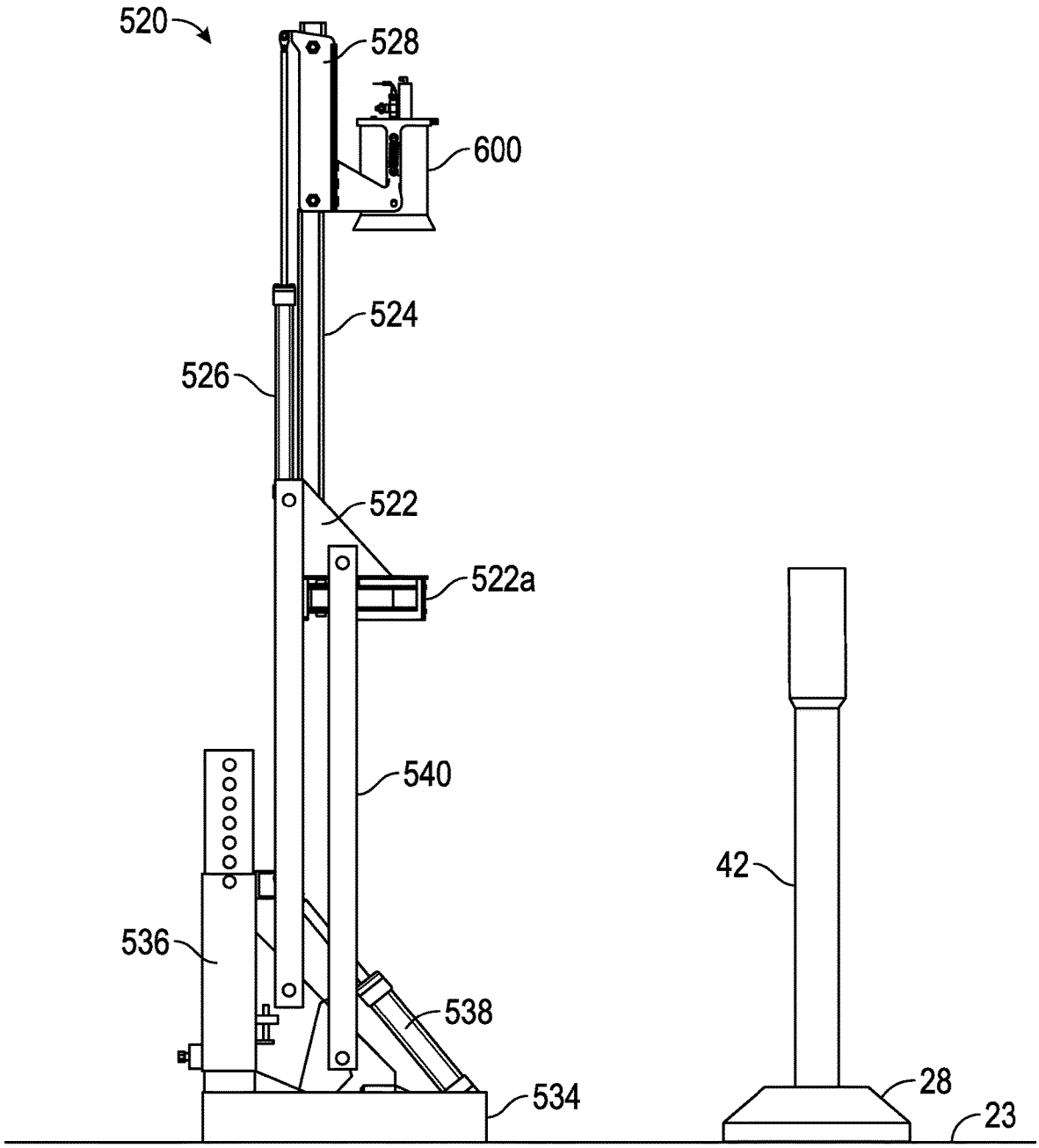
Figure 9F:
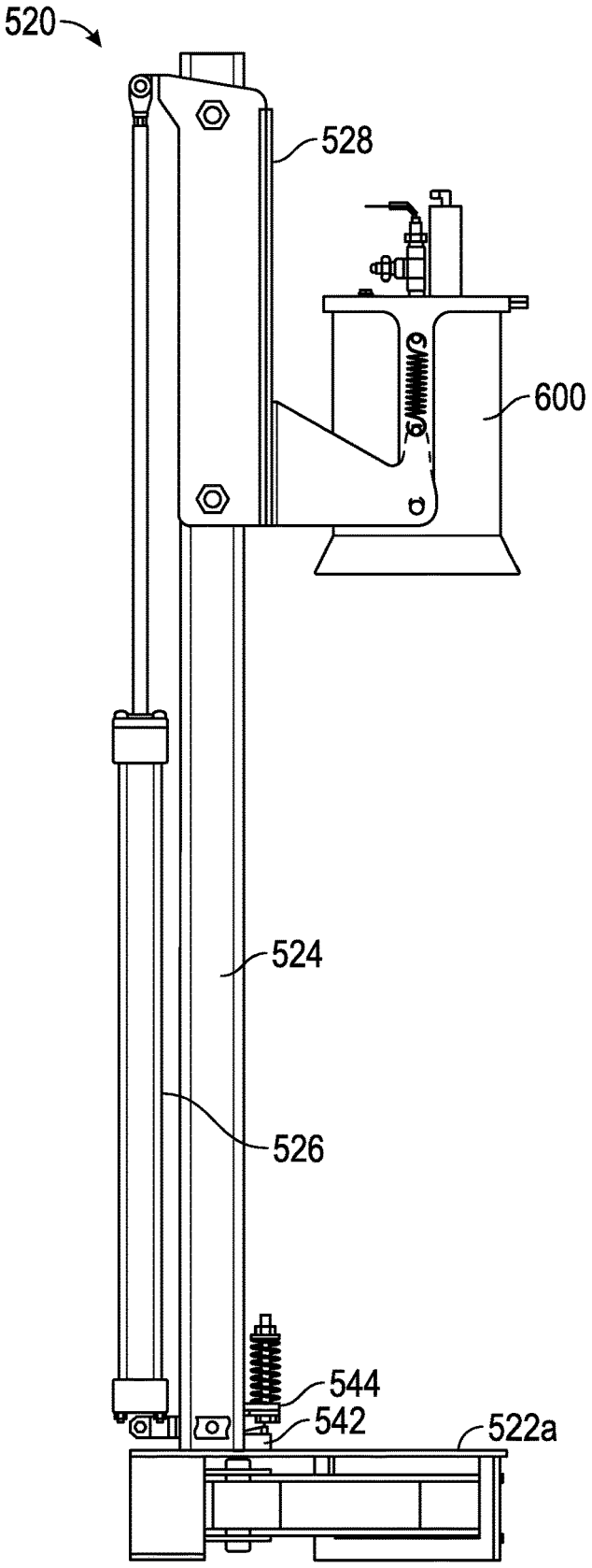
Figure 9G:
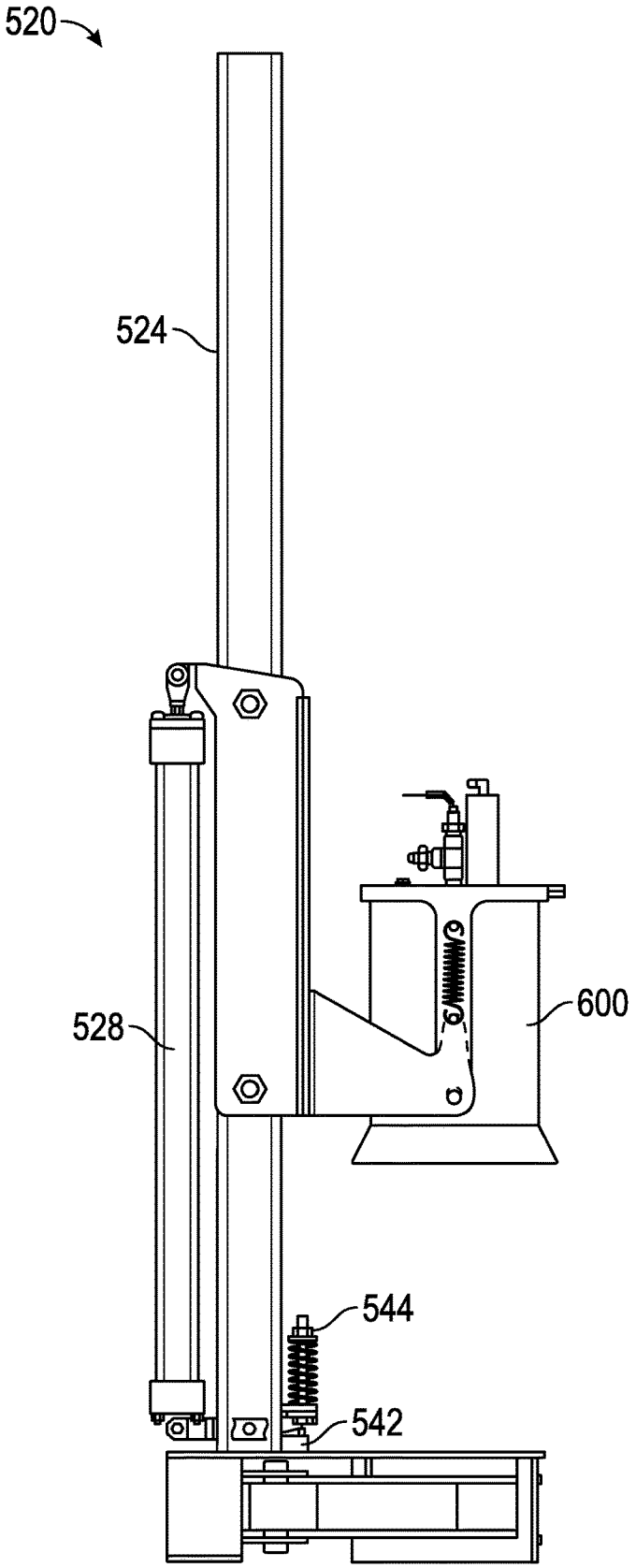

A method of utilizing system 520 to lubricate and test the conductors and communicative couplers of a WDP tubular as it is being displaced relative to wellbore 16 includes disposing system 600 over an end of a WDP tubular via rotating system 600 between the parked position shown in FIG. 9A and the extended position shown in FIG. 9B. Sliding bracket 528 and system 600 are then lowered relative support member 524 until system 600 is disposed over an end of tubular 42. The couplers of tubular 42 may then be tested, which may then be followed by lubricating the threads of the tubular, stabbing the tubular into the drill string and making up the tubular with the drill string by spinning the tubular and to lock the threads of the tubular with the threads of an adjacent tubular of the drill string. Following makeup, system 600 may be displaced upward along support member 522 and arms 540 may be rotated back into the parked position to provide access to the area surrounding slips 28. Another method of utilizing system 520 may include breaking apart two WDP tubulars and then testing the conductivity of the newly exposed end of a tubular as it is being displaced upward through the centralizer 532.

Figure 10A:
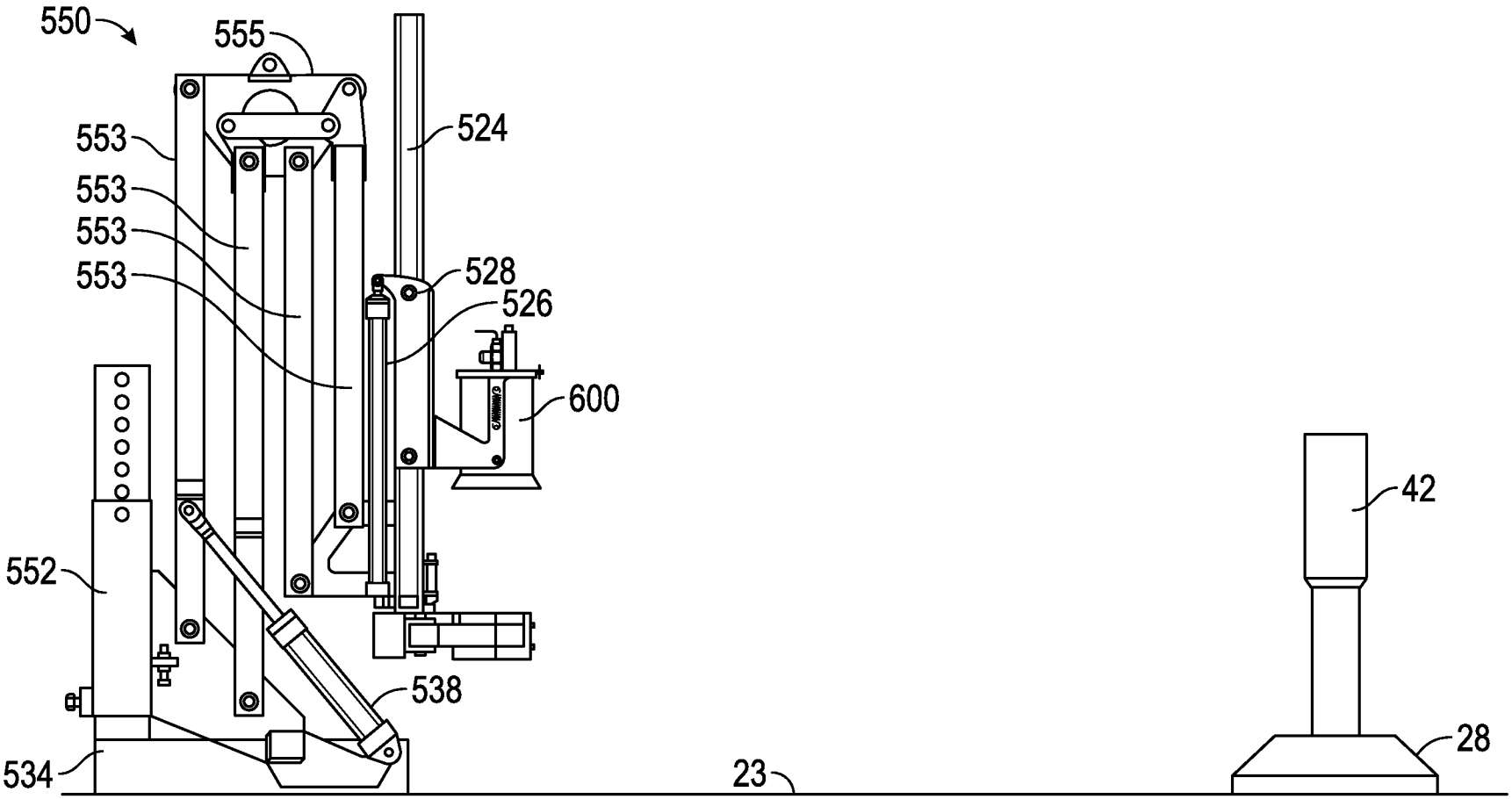
FIG. 10A is a side view of another embodiment of a system for supporting a lubrication and coupler apparatus in accordance with principles disclosed herein shown in a parked position.
Figure 10B:
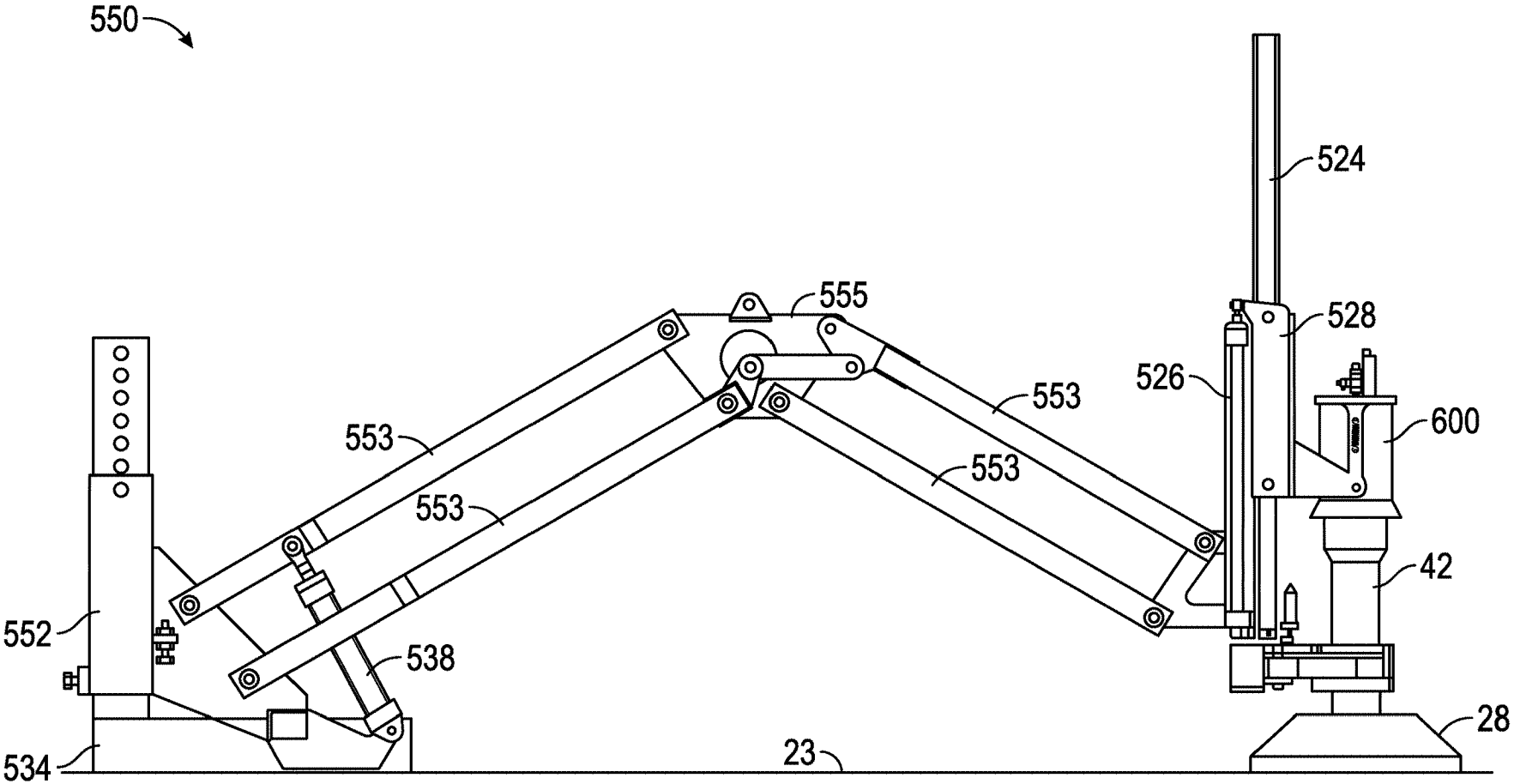
FIG. 10B is a side view of the support system of FIG. 10A in an extended position.

Referring to FIGS. 10A and 10B, another embodiment of a system 550 for supporting coupler and servicing system 600 is shown. In this embodiment, a support bracket 552 is coupled to mounting member 534 and may be disposed at varying vertical positions on member 534 depending on the needs of the application. A set of articulated arms 553 are coupled to bracket 552 and sliding bracket 528 and are configured to position system 600 both vertically and laterally relative tubular 42 and slips 28 via the articulation of arms 552 and rotation of arms 553 using actuator 538. A stabilizer 555 is coupled between each pair of arms 553 to allow the arms to fully extend into the extended position. In various embodiments, servicing system 600 may comprise a conductivity tester for testing the conductivity of coupler 48 and cable 48*a* of tubular 42, a cleaner for lubricating threads 46 of tubular 42, and a lubricator for lubricating threads 46. Further, servicing system 600 may be a combination comprising one or more of a conductivity tester, a thread cleaner, and a thread lubricator.

Figure 11A:
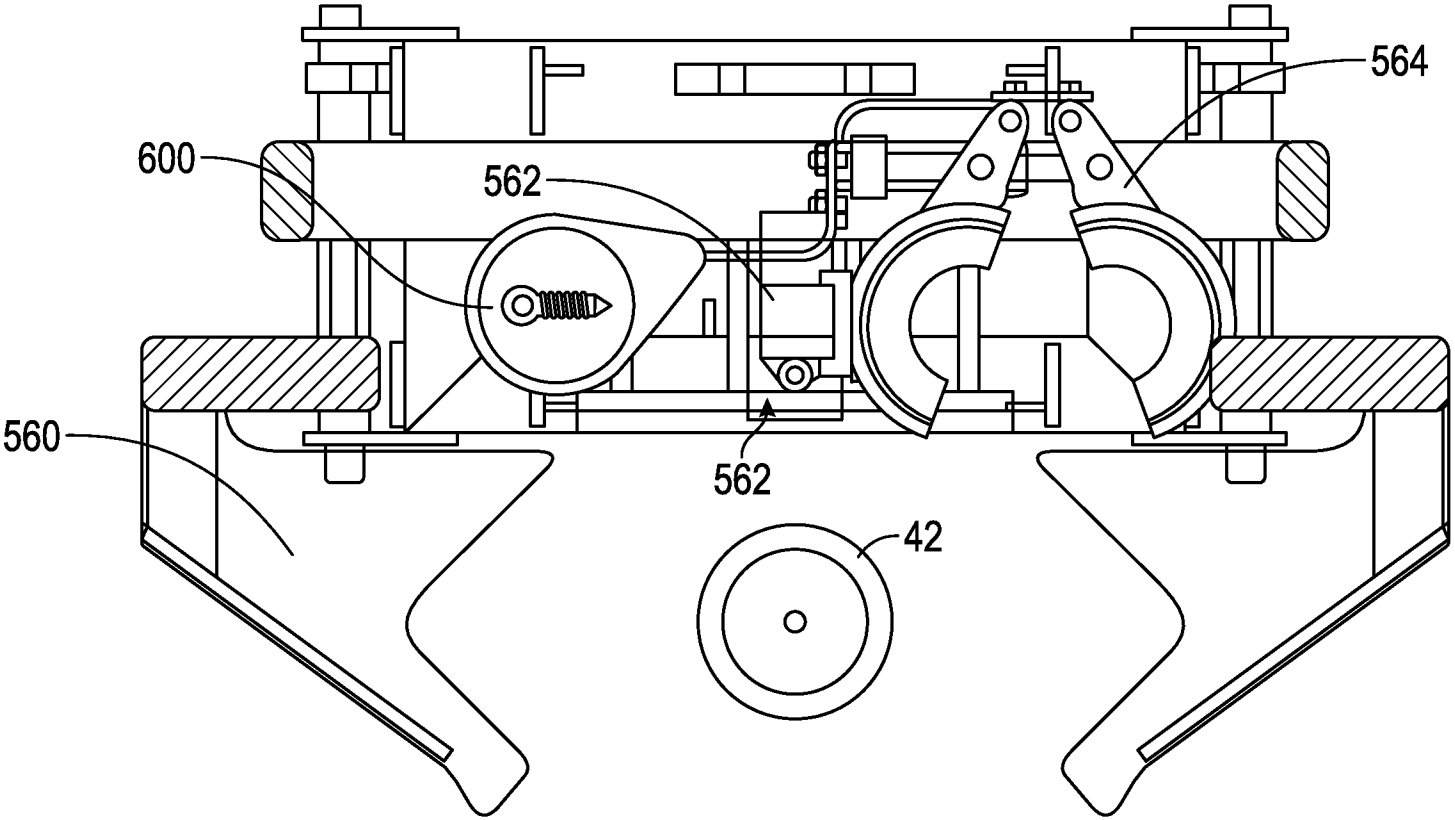
FIGS. 11A-11C are top views of an embodiment of a system for supporting a combination of a stabbing guide and a lubrication apparatus in accordance with principles disclosed herein.
Figure 11B:
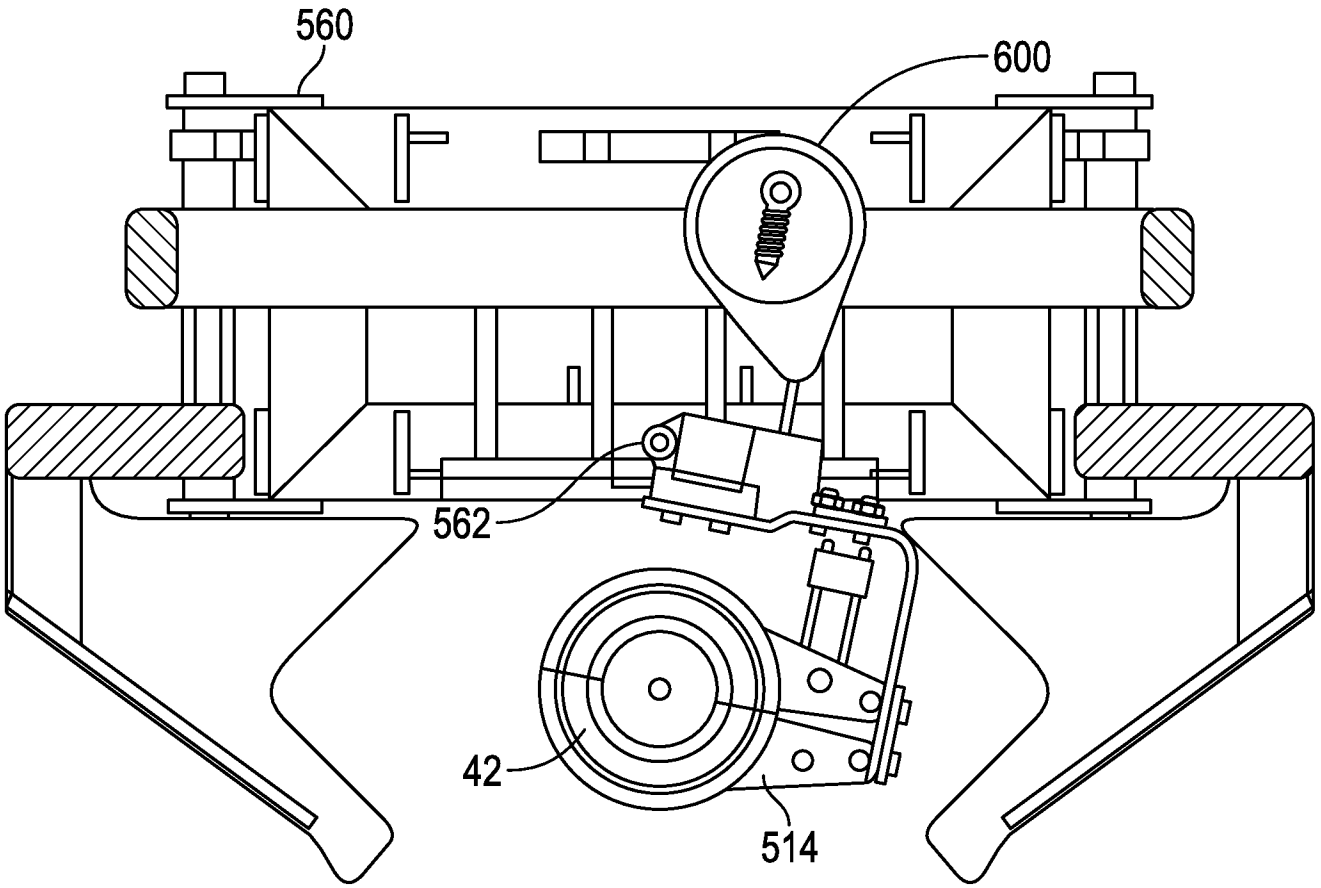
Figure 11C:
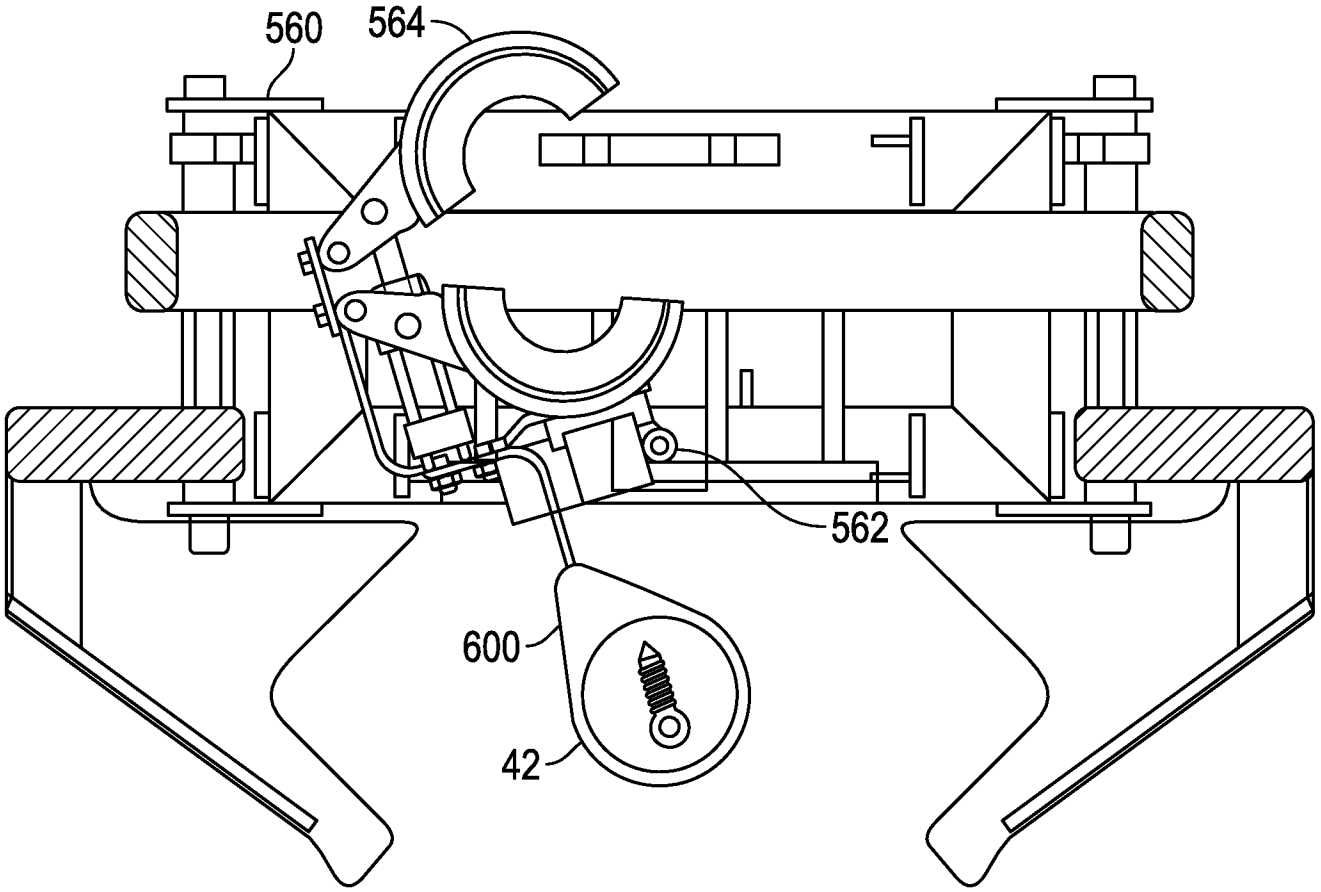

Referring now to FIGS. 11A-11C, a base 560 may be used in support systems 520 and 550 in lieu of the earlier described base 522. Specifically, base 560 may be coupled to a pair of arms (such as arms 540 of system 520 or arms 553 of system 550) and displaced between a parked position and an extended position. Alternatively, base 560 may be coupled to the rig floor 23 in a position adjacent to the slips 28. Base 560 includes a rotatable hinge 562 that is coupled both to system 600 and a stabbing guide 564. Rotation of hinge 562 transitions base 560 between a parked position (shown in FIG. 11A) where the stabbing guide 564 disposed over slips 28 (shown in FIG. 11B), and an extended position where system 300 is disposed over slips 28 and tubular 42 (shown in FIG. 11C). Rotation of hinge 562 may be controlled and powered using pneumatic, hydraulic, electric or other means. For instance, the power required to rotate hinge 562 may be supplied by supply system 26 via cables connecting actuator 562 with system 26.

Figure 12:
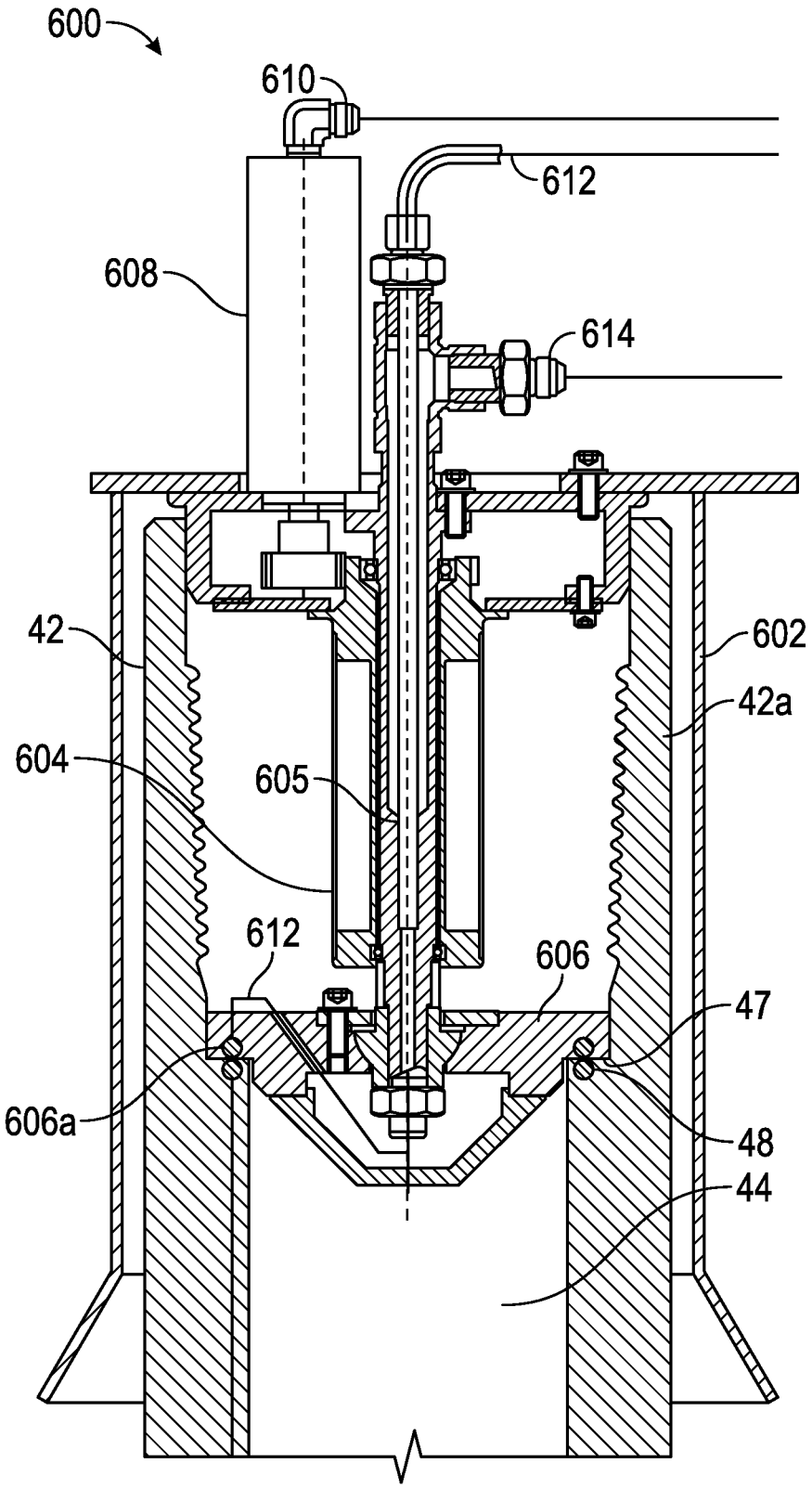
FIG. 12 is a partial sectional view of an embodiment of a lubrication and coupler apparatus in accordance with principles disclosed herein shown in a parked position.

Referring now to FIG. 12, an embodiment of a servicing system 600 is shown. In this embodiment, system 600 generally includes an outer drum 602, a perforated drum 604 disposed about a spindle 605, a testing flange 606 having a testing communicative coupler 606*a*, an air motor 608, an air supply 610, an electrical conductor 612 and a lubricant supply 614. A test of the couplers of tubular 42 may be performed by physically contacting coupler 606*a* of system 600 with a coupler of tubular 42. Thus, a test of the couplers of tubular 42 may be performed without threading any component into the box end of tubular 42, which may increase the reliability and time required for performing the testing operation. For instance, threadless coupler 606*a* is not susceptible to issues with threads locking or other issues that may make it difficult to provide the amount of physical engagement required for performing a conductivity test. Following the conductivity test, threads of the box end of tubular 42 may be lubricated using system 600 prior to being made up with an adjacent tubular. The threads of tubular 42 may be lubricated via providing lubricant using supply 614 to the perforated drum 604 using air motor 608 and air supply 610. Drum 604 may be rotated within the box end of tubular 42 in order to use centripetal force to eject lubricant disposed within drum 604 evenly along the threads of tubular 42. Following lubrication of the threads of tubular 42, system 600 may be vertically displaced relative 42 to allow for the makeup of tubular 42 as described earlier with reference to systems 520 and 550.

Figure 13A:
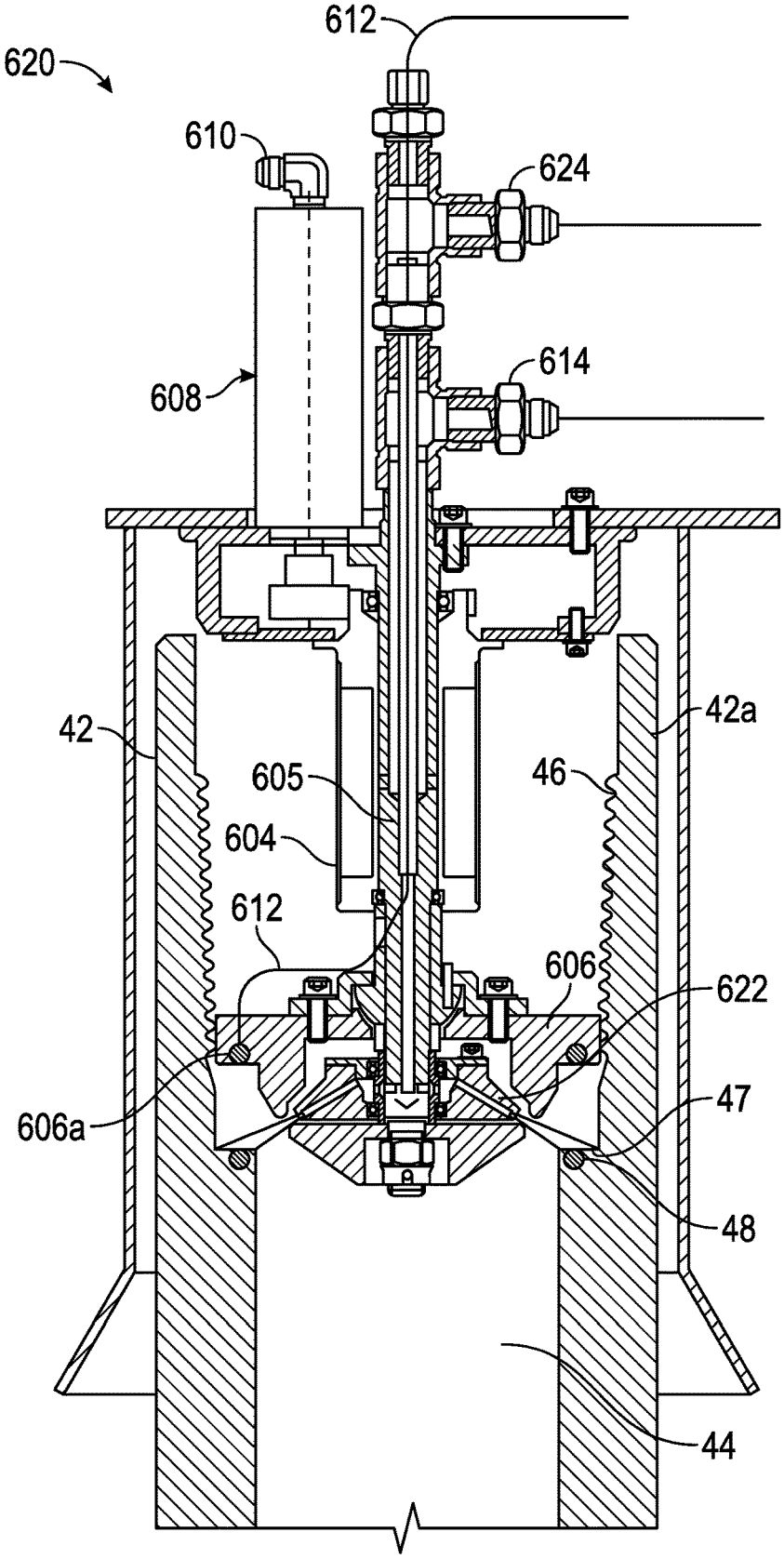
FIG. 13A is a partial sectional view of an embodiment of a lubrication, coupler and cleaner apparatus in accordance with principles disclosed herein shown in a cleaning position.
Figure 13B:
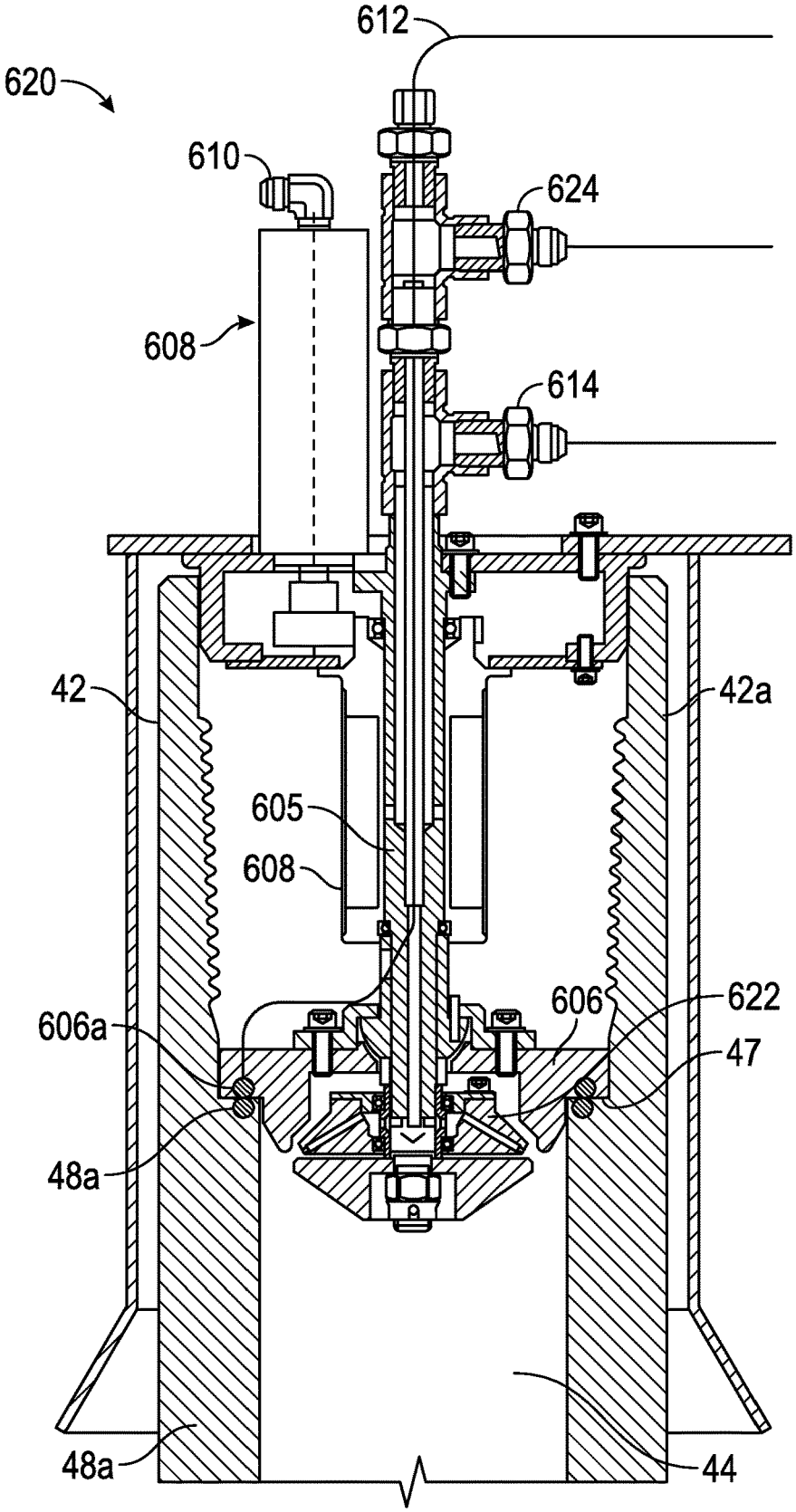
FIG. 13B is a partial sectional view of the system of FIG. 14A in a coupled position.

Referring now to FIGS. 13A and 13B, an embodiment of an apparatus 620 for cleaning, conductively testing and lubricating a tubular is shown. Apparatus 620 generally includes many of the same components of apparatus 600 shown in FIG. 12, but further includes a rotatable cleaner 622 having a pressurized air supply 624. Prior to performing the conductive test of the box end coupler of tubular 42, the outer surface of the flange housing the coupler may be cleaned via cleaner 622 in order to provide more intimate physical engagement between testing flange 606*a* and tubular 42. The air supply 610 used to rotate perforated drum 604 may be used to also rotate cleaner 622. The air used to rotate cleaner 622 may also be ejected from cleaner 622 in a trajectory directed towards the flange 47 of tubular 42, such as to clean the outer surface by blowing away and debris or other materials disposed on the flange. Following cleaning, a conductive test and lubrication of the threads 46 at the box end 48*a* may follow accordingly as described previously with respect to apparatus 600.

Figure 14A:
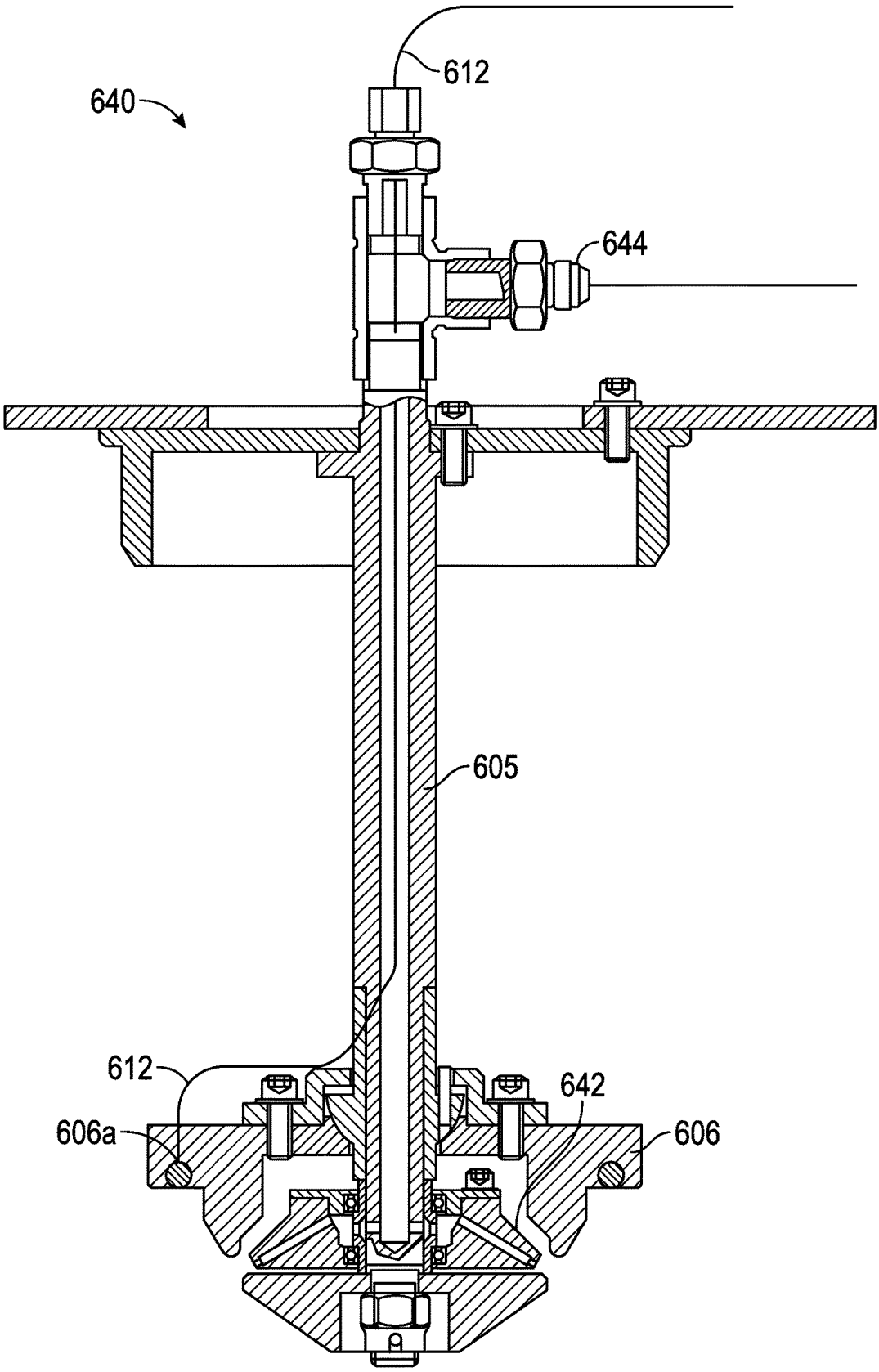
FIG. 14A is a partial sectional view of an embodiment of an apparatus for cleaning and performing conductive testing of a tubular in accordance with principles disclosed herein.

Referring now to FIG. 14A, an embodiment 630 of an apparatus for cleaning and performing conductive testing of a tubular is shown. Similar to apparatus 620, apparatus 630 generally includes air supply 610, testing flange 606 with coupler 606*a* and cleaner 622. However, in contrast to apparatus 620, apparatus 630 includes a modified drum 632 and does not include a perforated drum (such as drum 604) or other means for lubricating threads 46 at each end of tubular 42. Instead, apparatus 630 is only configured to clean an inner flange (e.g., flange 47) of tubular 42. Therefore, in this embodiment, electrical conductor 612 may need not be disposed within steel tubing or routed within a central passage of apparatus 670.

Figure 14B:
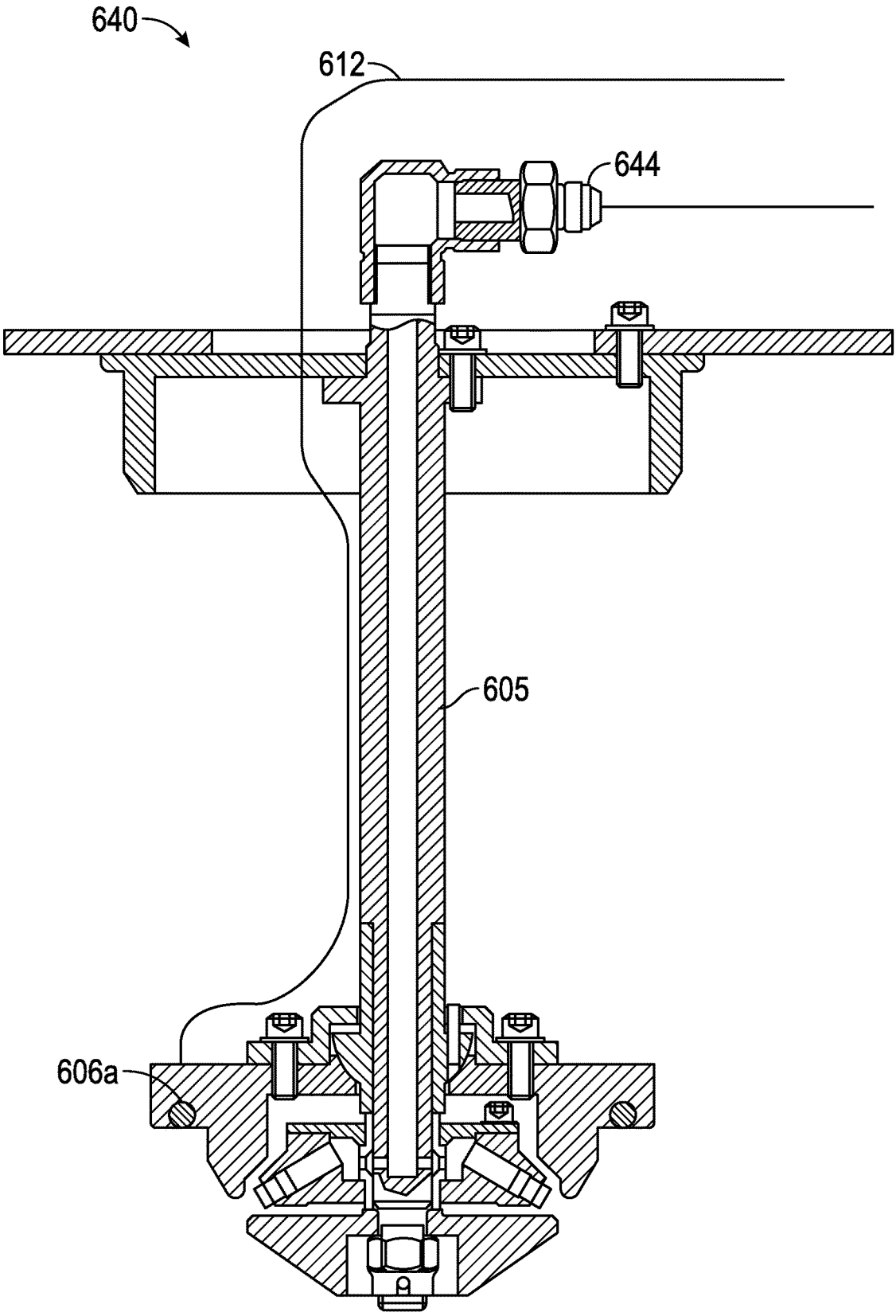
FIG. 14B is a partial sectional view of another embodiment of an apparatus for cleaning and performing conductive testing of a tubular in accordance with principles disclosed.

Referring now to FIG. 14B, another embodiment 640 of an apparatus for cleaning and performing conductive testing of a tubular is shown. Apparatus 640 is configured similarly with respect to apparatus 630. However, apparatus but includes a water cleaner 642 and an associated water supply 644 in lieu of the air cleaner 622 of apparatus 630. In this embodiment, pressurized water flows into apparatus 640 via water supply 644. Cleaner 642 is configured such that the entering pressurized water acts to both rotate cleaner 642 and discharge streams of pressurized water on a trajectory directed towards the internal flange (e.g., flange 47) of tubular 42 housing the coupler. Also, FIGS. 14A and 14B demonstrate that wire 612 may travel through or adjacent to spindle 605.

Referring to FIGS. 15A-15G, embodiments of conductivity testers or testing apparatuses are shown. The conductivity testers shown in FIGS. 15A-15G are configured to allow the testing of coupler 48 and wire 48*a* without needing to threadedly engage tubular 48 itself, such as using threads 46. Thus, threads 46 of tubular 48 need not be cleaned and lubricated in order for coupler 48 and wire 48*a* to be tested for conductivity. The testers of FIGS. 15A-15G may be operated at wellsite 10 or in another location remote from wellsite 10. Also, tubular 48 may be disposed in either vertical or horizontal positions when tested for conductivity. Further, the embodiments of conductivity testers illustrated in FIGS. 15A-15G include common features and components, and thus such common features and components are labeled similarly.

Figure 15A:
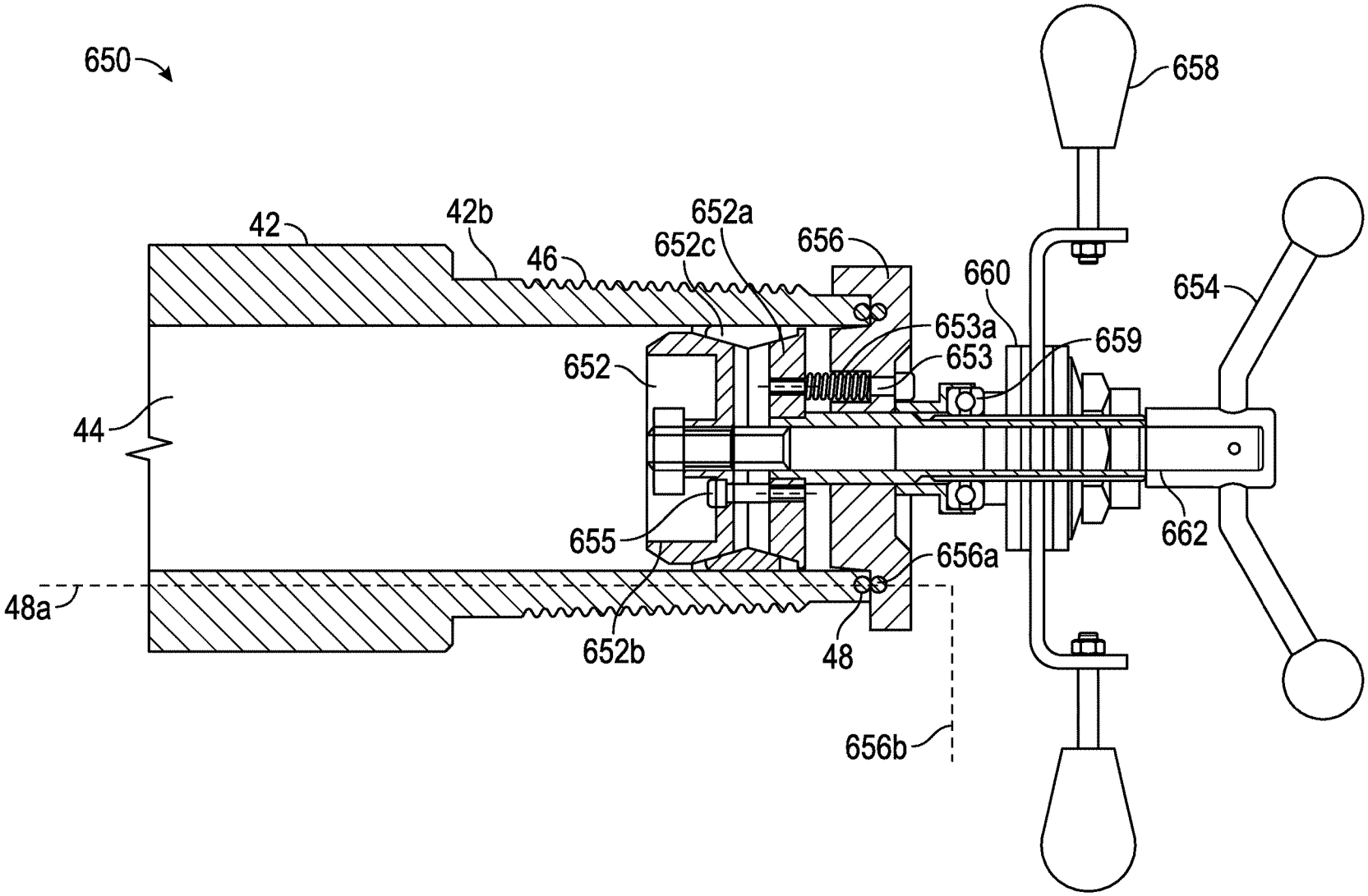
FIGS. 15A-15G are partial sectional views embodiments of couplers in accordance with principles disclosed herein.

In the embodiment shown in FIG. 15A, a tester 650 for conductively testing a pin end 42*b* of tubular 42 generally includes a locking assembly 652, a locking lever 654, a testing flange 656 having a communicative coupler 656*a* and a measurement wire connection 656*b*, a pushing lever 658, a torque limiter 660, and a spindle 662. The locking assembly 652 generally comprises a first or upper flange 652*a*, a lower flange 652*b*, and an engagement member 652*c* disposed between the upper and lower flanges 652*a* and 652*b*, respectively. The lower flange 652*b* is coupled to locking lever 654 via spindle 662, which extends between lever 654 and lower flange 652*b*. Thus, lower flange 652*b* may be displaced axially along central axis 45 of tubular 42 by rotation of lever 654. Axial force may be applied to testing flange 656 via rotation of pushing lever 658, which is coupled to torque limiter 660. Limiter 660 is coupled to spindle 662 and threaded engagement between torque limiter 660 and spindle 662 produces an axial force on a bearing 659, which transmits the axial force to the testing flange 656.

Tester 650 also comprises a first or upper pin 653, which couples testing flange 656 to upper flange 652*a* of locking assembly 652. Upper pin 653 allows for relative axial movement between flange 656 locking assembly 652, but forcibly acts against pivoting of upper flange 652 about spindle 662 via spring 653*a*. For instance, engagement between flange 652*a* and engagement member 652*c* may produce a torque on flange 652*a*, urging the pivoting of upper flange 652*a* where one circumferential end of flange 652*a* is urged towards testing flange 656. Because pin 653 is offset from the central axis of spindle 662 and flange 652*a*, the pivoting force provided by engagement between flange 652*a* and member 652*c* is resisted by a pivoting force provided by spring 653*a*. Tester 650 further includes a lower spring 655 coupled to lower flange 652*b*, which provides a stop or minimum axial distance between upper flange 652*a* and lower flange 652*b*. As lower flange 652*b* is displaced towards upper flange 652*a*, at a predetermined minimum distance the lower pin 655 will engage upper flange 652*a*, preventing any further axial displacement of lower flange 652*b*.

Coupler 650 is locked into position proximal the pin end of tubular 42 using the locking assembly 652 and locking lever 654. Specifically, once coupler 650 has been appropriately positioned, locking lever 654 may be rotated, causing vertical displacement of locking assembly 652 relative to lever 654, which forcibly engages an outer portion of assembly 652 against an inner surface of tubular 42. Once locked into position using locking assembly 652, the testing flange 656 may be urged against a corresponding flange of tubular 42 using the pushing lever 658. Rotation of pushing lever 658 results in a force on flange 656 in the direction of the flange of tubular 42. The maximum force applied to flange 656, and thus provided to coil 656*a* of flange 656, may be limited via the torque limiter 660. In this embodiment, torque limiter 660 includes a clutch assembly (not shown) that limits the maximum amount of torque applicable to pushing lever 660, which in turn limits the maximum force applicable to testing flange 656 in the direction of tubular 42. Thus, torque limiter 660 may be set to a predetermined setting that corresponds to a predetermined level of force desired between coupler 656*a* and the coupler disposed at the pin end of tubular 42. The ability to threadlessly engage flange 656 against tubular 42 and provide a predetermined maximum torque setting may increase the reliability of a conductive test performed using coupler 650 on the tubular 42.

Figure 15B:
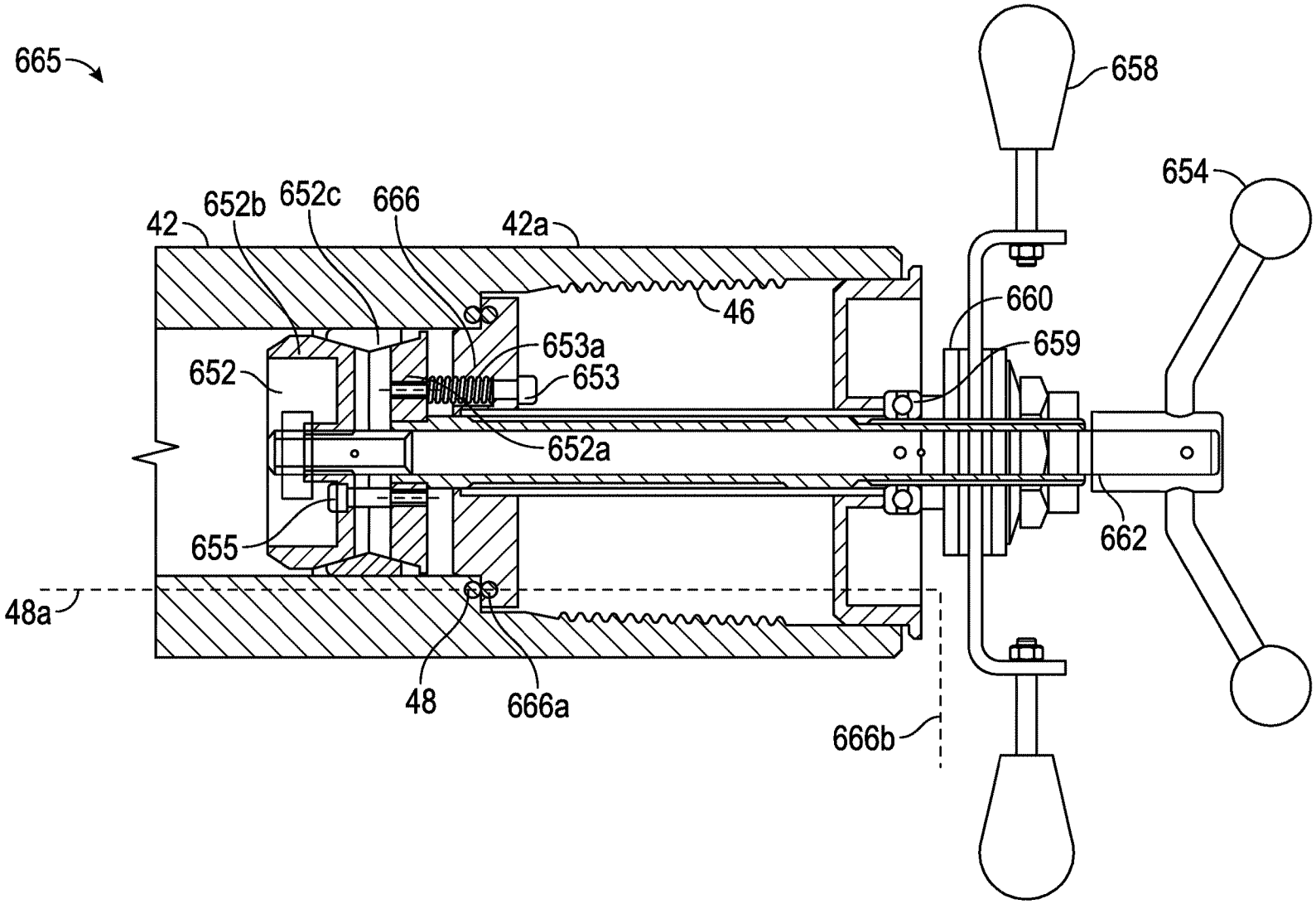
Figure 15C:
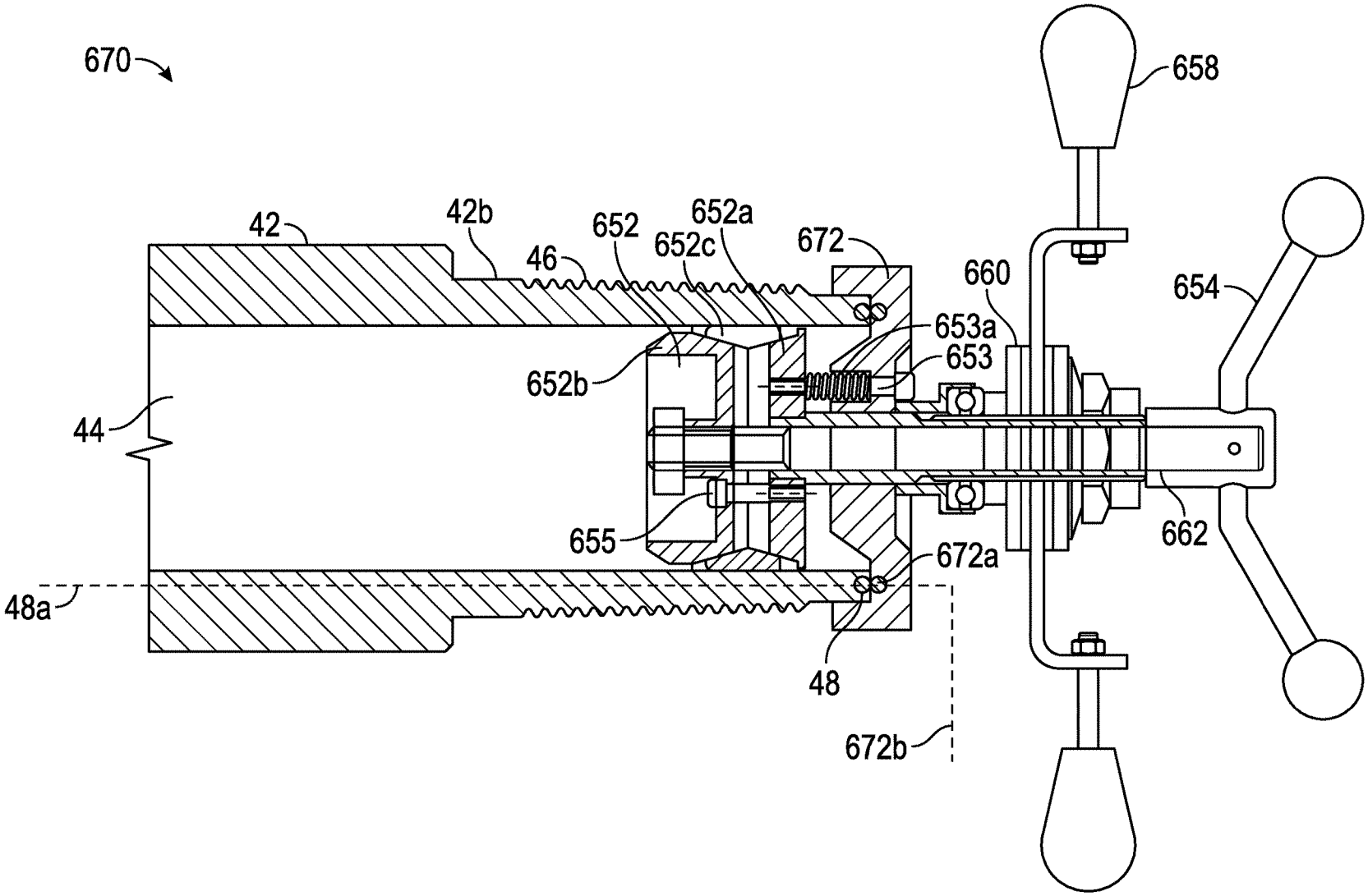
Figure 15D:
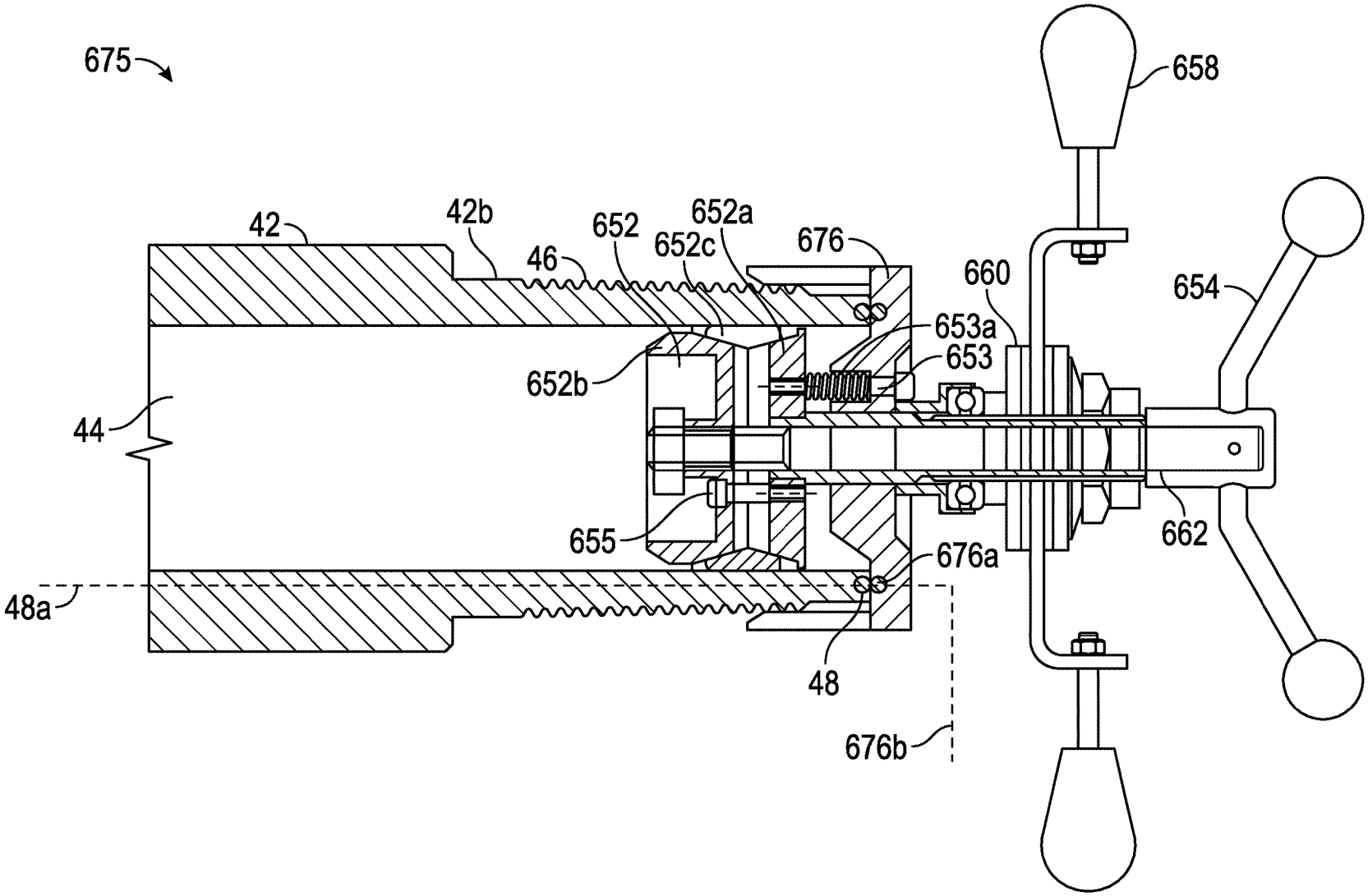

FIGS. 15B-15D illustrate embodiments of couplers 665, 670 and 675, respectively, for performing a conductive test of couplers disposed at the pin end of tubular 42. Coupler 665 includes a modified testing flange 666 having a communicative coupler 666*a* and a conductor 666*b*. Couplers 670 and 675 include modified flanges 672 and 676, respectively. The flanges 666, 672 and 676 of couplers 665, 670 and 675 respectively, may be preferable depending on the particular application. For instance, flange 666 is configured for engagement with box end 42*a* of tubular 42 while flanges 672 and 676 are configured for engagement with pin end 42*b* of tubular 42.

Figure 15E:
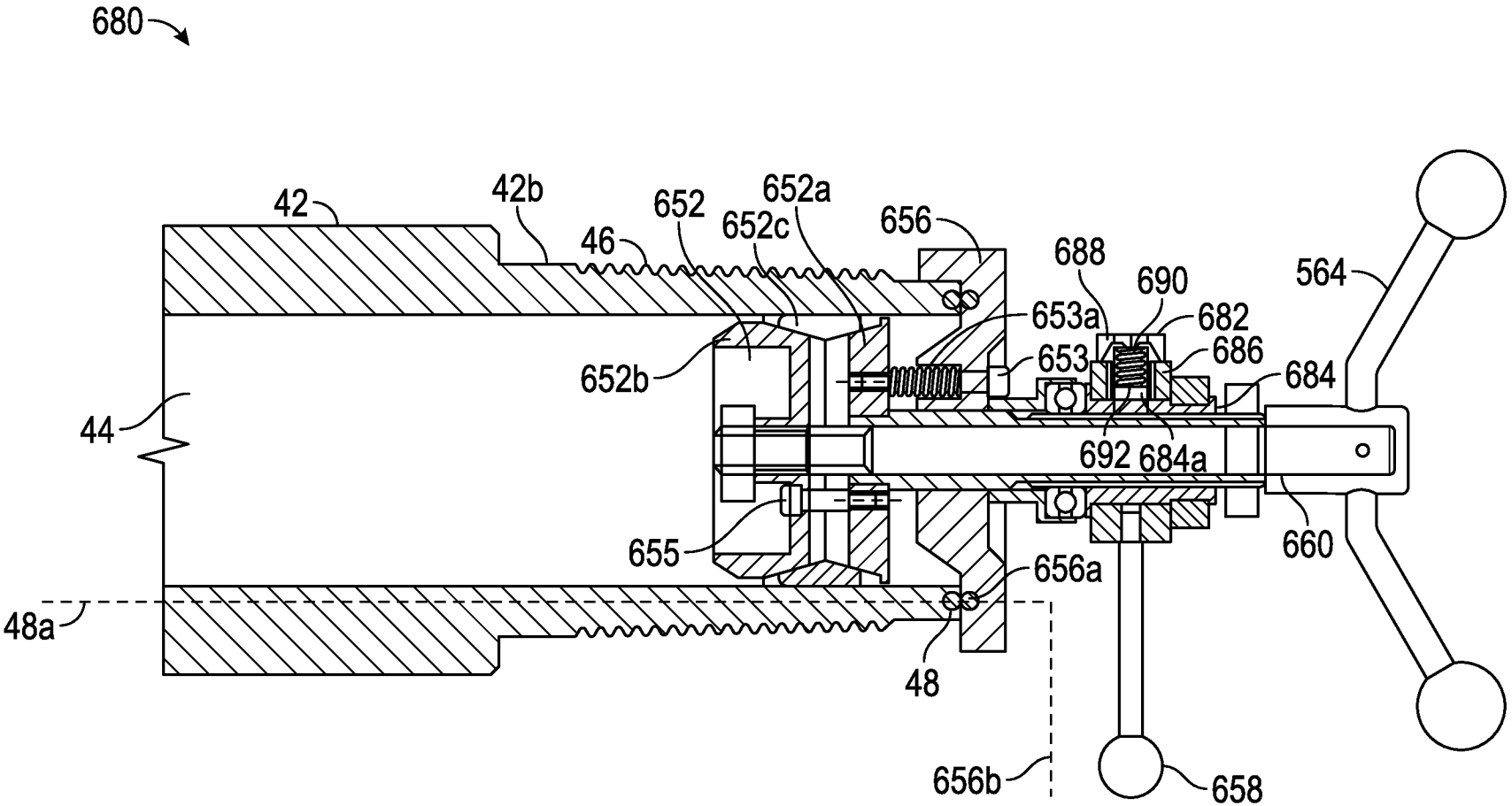
Figure 15G:
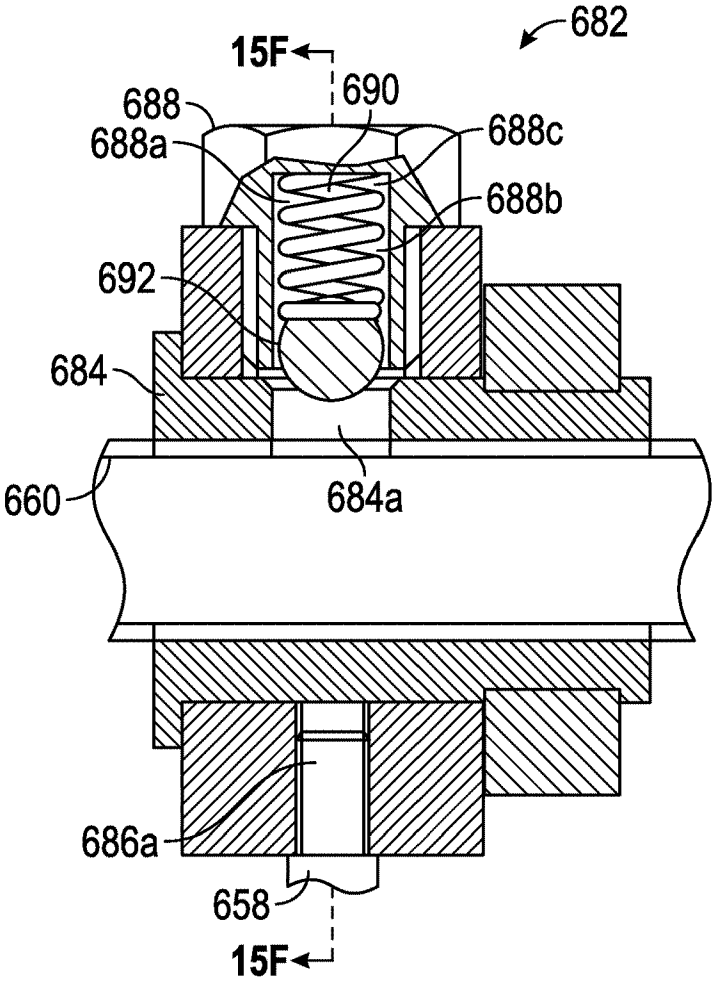
Figure 15F:
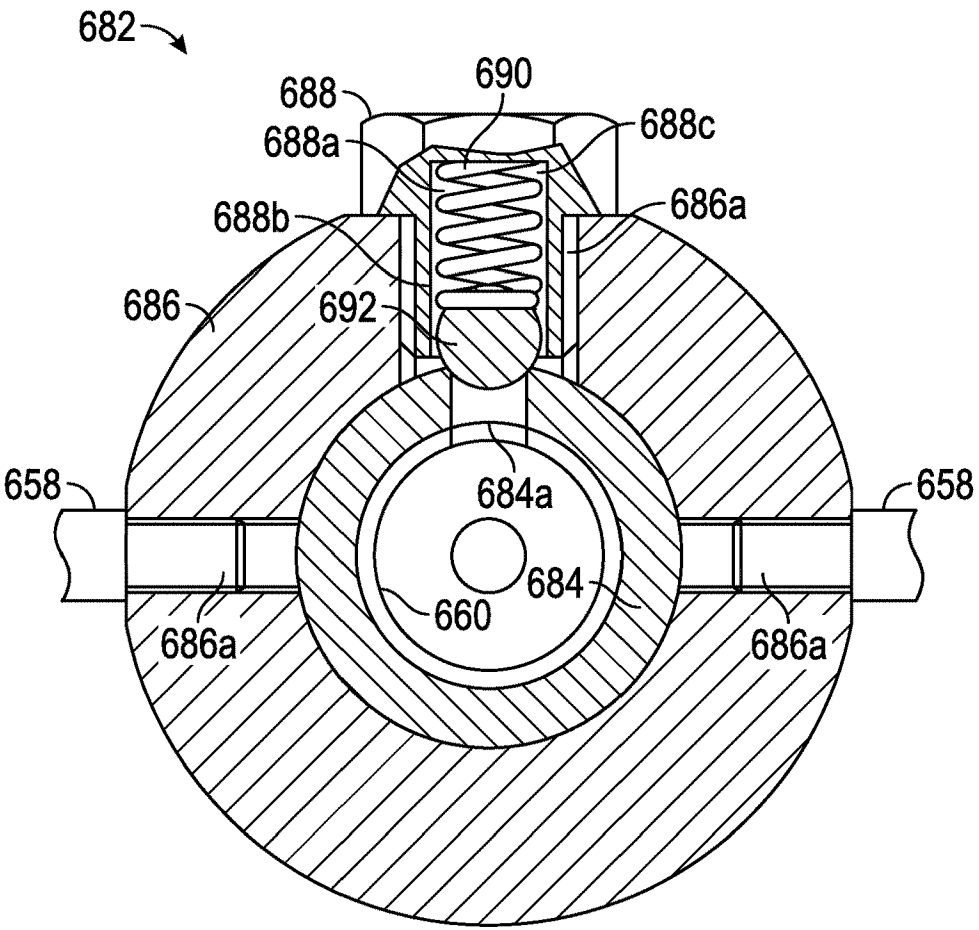

FIGS. 15E-15G illustrate another embodiment of a conductivity tester 680 that includes a spring-based torque limiter. In this embodiment, instead torque limiter 660, tester 680 utilizes spring-based torque limiter 682, which generally comprises an inner mandrel 684 having a radial aperture 684*a*, an outer mandrel 686 having a plurality of circumferentially spaced apertures 686*a*, and a hollow bolt 688 having a spring 690 and a ball 692 disposed therein. Hollow bolt 688 extends into and is threadedly coupled to one of the apertures 686*a*. A cavity 688*a* extends into bolt 688 and is defined by an inner surface 688*b* having an upper end or surface 688*c*. Spring 690 extends within cavity 688*a*, engaging upper surface 688*c* of bolt 688 and the outer surface of ball 692. Ball 692 is configured to fit partially within radial aperture 684*a* of inner mandrel 684. Thus, when the torque applied to limiter 682 has not exceeded a predetermined threshold, ball 692 is urged by spring 690 towards inner mandrel 684, such that a portion of ball 692 is disposed within aperture 684*a* of mandrel 684.

One or more pushing levers 658 are disposed in apertures 686*a* of outer mandrel 686. Thus, torque is applied to outer mandrel 686 via rotation of pushing lever 658. The torque applied to mandrel 686 is transmitted to inner mandrel 684 through ball 692 via engagement between inner surface 688*b* of bolt 688 and ball 692, and engagement between ball 692 and an inner surface of aperture 684*a* of inner mandrel 684. Inner mandrel 684 is threadably coupled to spindle 692, and thus as mandrel 684 is rotated, additional axial force is applied to bearing 659 and testing flange 656. Additional axial force applied to bearing 659 requires, in turn, additional torque to be applied to pushing lever 658.

As the amount of torque applied to pushing lever 658 increases, the amount of force applied to ball 692 by inner surface 688*b* of bolt 688 and the inner surface of radial aperture 684*a*. However, while the force applied to ball 692 by inner surface 688*b* is normal to the central axis of bolt 688, the force applied to ball 692 by aperture 684*a* is at an angle relative to the central axis of bolt 688. Thus, an upward component of the force applied to ball 692 by aperture 684*a* of inner mandrel 684 is directed towards upper surface 688*c* of the cavity 688*a* of bolt 688. This upward component resists the downward axial force provided by spring 690 against ball 692. Once the amount of torque provided by pushing lever 688 exceeds a predetermined threshold, the amount of upward force provided by aperture 684*a* of mandrel 684 exceeds the amount of downward force provided by spring 690, causing ball 692 to displace upwardly towards upper surface 688*c* of cavity 688*a*. Once ball 692 has been displaced upwards towards upper surface 688*c*, torque may longer be transmitted between upper mandrel 686 and lower mandrel 684. Further, the predetermined torque threshold may be configured by varying the spring rate of spring 690. For instance, a spring 690 having a relatively low spring rate (i.e., one that requires more axial force to compress) will allow for the application of a greater amount of torque to lower mandrel 684.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A wellsite system comprising:

a drilling rig comprising a rig floor;

an elevator coupled to the drilling rig and suspended above the rig floor, the elevator configured to support a tubular and transport the tubular towards a drillstring extending from a wellbore of the wellsite system whereby the tubular may couple to the drillstring; and a support system disposed on the drilling rig comprising:

a housing positioned on the elevator;

a bracket member pivotably coupled to the housing;

an actuatable arm coupled to the bracket member and configured to be moveable between a first position and a second position that is spaced from the first position along a longitudinal axis of the bracket member; and a servicing system coupled to the actuatable arm, wherein the servicing system is configured to threadlessly engage a tubular.

2. The wellsite system of claim 1, wherein the servicing system comprises at least one of a conductivity tester, a lubricator, and a thread cleaner.

3. The wellsite system of claim 1, wherein the servicing system comprises a combination tool configured to test the conductivity of a communicative coupler of a tubular, and lubricate the threads of the tubular.

4. The wellsite system of claim 1, wherein the servicing system comprises a combination tool configured to test the conductivity of a communicative coupler of a tubular, clean the threads of the tubular, and lubricate the threads of the tubular.

5. The wellsite system of claim 1, wherein the bracket member is configured to pivot into alignment with a central axis of the tubular.

6. The wellsite system of claim 1, wherein the actuatable arm is configured to move the servicing system in a direction coaxial with a central axis of the tubular.

7. The wellsite system of claim 1, further comprising:

a mounting member coupled to the rig floor;

a base comprising a centralizer configured to couple with the tubular member; and an actuatable support arm coupling the mounting member to the base, wherein the actuatable support arm is configured to move the base from a retracted position and an extended position;

wherein the centralizer contacts the tubular when the base is in the extended position.

8. A wellsite system comprising:

a drilling rig;

an elevator coupled to the drilling rig, the elevator configured to support a tubular; and a support system disposed on the drilling rig comprising:

a housing coupled to the drilling rig;

a bracket member pivotably coupled to the housing;

an actuatable arm coupled to the bracket member and configured to be moveable between a first position and a second position that is spaced from the first position along a longitudinal axis of the bracket member; and a servicing system coupled to the actuatable arm, wherein the servicing system is configured to threadlessly engage a tubular and wherein the servicing system comprises a combination tool configured to test the conductivity of a communicative coupler of a tubular and lubricate the threads of the tubular.

9. The wellsite system of claim 8, wherein the housing is coupled to the elevator.

10. The wellsite system of claim 9, wherein the combination tool is configured to clean the threads of the tubular.

11. The wellsite system of claim 9, wherein the bracket member is configured to pivot into alignment with a central axis of the tubular.

12. The wellsite system of claim 9, wherein the actuatable arm is configured to move the servicing system in a direction coaxial with a central axis of the tubular.

13. The wellsite system of claim 8, further comprising:

a mounting member coupled to the floor of the drilling rig;

a base comprising a centralizer configured to couple with the tubular member; and an actuatable arm coupling the mounting member to the base, wherein the actuatable arm is configured to move the base from a retracted position and an extended position;

wherein the centralizer contacts the tubular when the base is in the extended position wherein the base is coupled to the housing of the support system.

14. The wellsite system of claim 8, wherein a lubricator of the combination tool is insertable into a central passage of the tubular to lubricate the threads of the tubular.

* * * * *